US009009894B2

(12) United States Patent
Radermacher

(10) Patent No.: US 9,009,894 B2
(45) Date of Patent: Apr. 21, 2015

(54) CHIROPRACTIC POSTURE CORRECTION TOOL

(75) Inventor: Mark Radermacher, Elroy, WI (US)

(73) Assignee: Posture Correction Tools, LLC, Milwaukee, WI (US)

( * ) Notice: Subject to any disclaimer, the term of this patent is extended or adjusted under 35 U.S.C. 154(b) by 920 days.

(21) Appl. No.: 12/678,662

(22) PCT Filed: Sep. 22, 2008

(86) PCT No.: PCT/US2008/077260

§ 371 (c)(1), (2), (4) Date: Mar. 17, 2010

(87) PCT Pub. No.: WO2009/039514

PCT Pub. Date: Mar. 26, 2009

(65) Prior Publication Data

US 2010/0211099 A1 Aug. 19, 2010

Related U.S. Application Data

(60) Provisional application No. 60/973,798, filed on Sep. 20, 2007.

(51) Int. Cl.

| | |
|---|---|
| ***A47B 7/00*** | (2006.01) |
| ***A61G 13/00*** | (2006.01) |
| ***A61G 13/08*** | (2006.01) |
| ***A61G 13/12*** | (2006.01) |

(52) U.S. Cl.

CPC ..... *A61G 13/009* (2013.01); *A61G 13/08* (2013.01); *A61G 13/12* (2013.01); *A61G 13/121* (2013.01); *A61G 13/122* (2013.01); *A61G 13/123* (2013.01); *A61G 13/1235* (2013.01); *A61G 13/1245* (2013.01); *A61G 13/125* (2013.01); *A61G 13/1255* (2013.01); *A61G 2200/325* (2013.01)

(58) Field of Classification Search

USPC ..... 5/611, 613, 622, 624; 606/242; 601/5

See application file for complete search history.

(56) References Cited

U.S. PATENT DOCUMENTS

| | | | | | |
|---|---|---|---|---|---|
| 1,626,091 | A | * | 4/1927 | Macklin | 5/618 |
| 2,794,694 | A | * | 6/1957 | Fullwood et al. | 5/614 |
| 3,227,440 | A | * | 1/1966 | Scott | 5/618 |
| 4,230,100 | A | * | 10/1980 | Moon | 606/242 |
| 4,523,581 | A | | 6/1985 | Ekholm | |
| 5,192,306 | A | * | 3/1993 | Scott et al. | 606/243 |
| 5,427,436 | A | * | 6/1995 | Lloyd | 297/408 |
| 5,569,175 | A | * | 10/1996 | Chitwood | 602/32 |
| 5,774,915 | A | | 7/1998 | Scott et al. | |
| 5,778,467 | A | * | 7/1998 | Scott et al. | 5/613 |

(Continued)

FOREIGN PATENT DOCUMENTS

| | | |
|---|---|---|
| CN | 2834486 | 11/2006 |
| JP | 11-164858 | 6/1999 |

*Primary Examiner* — Scott Medway

(74) *Attorney, Agent, or Firm* — Joseph S. Heino; Patrick M. Bergin

(57) ABSTRACT

The claimed invention provides an improved posture correction tool in the form of a table to be used by chiropractic practitioners to treat mechanical disorders of the spine and musculoskeletal system. The improved posture correction tool provides a plurality of pads to support the various major areas of the body and has built in drop capability and adjustment capability for the pelvic pad, the lumbar pad, the thoracic pad and the head and cervical area. The claimed invention also has a novel cervical support.

22 Claims, 21 Drawing Sheets

(56) References Cited

U.S. PATENT DOCUMENTS

| | | | | |
|---|---|---|---|---|
| 5,784,734 | A * | 7/1998 | Scott et al. | 5/613 |
| 5,794,286 | A * | 8/1998 | Scott et al. | 5/611 |
| 6,073,284 | A * | 6/2000 | Borders | 5/600 |
| 6,081,947 | A * | 7/2000 | Disher | 5/632 |
| 6,272,853 | B1 * | 8/2001 | Broechmann | 60/414 |
| 6,484,334 | B1 * | 11/2002 | Borders et al. | 5/600 |
| 6,615,431 | B2 * | 9/2003 | Lin | 5/620 |
| 6,638,299 | B2 * | 10/2003 | Cox | 606/243 |
| 6,692,451 | B2 * | 2/2004 | Splane, Jr. | 601/5 |
| 6,718,580 | B2 * | 4/2004 | Heimbrock et al. | 5/617 |
| 6,739,006 | B2 * | 5/2004 | Borders et al. | 5/622 |
| 6,754,923 | B2 * | 6/2004 | Borders et al. | 5/624 |
| 6,899,690 | B2 * | 5/2005 | Saunders et al. | 602/36 |
| 2003/0040686 | A1 | 2/2003 | Schaeffer | |
| 2003/0055456 | A1 * | 3/2003 | Cox | 606/243 |
| 2005/0222523 | A1 * | 10/2005 | Splane et al. | 601/5 |
| 2010/0211099 | A1 * | 8/2010 | Radermacher | 606/245 |

* cited by examiner

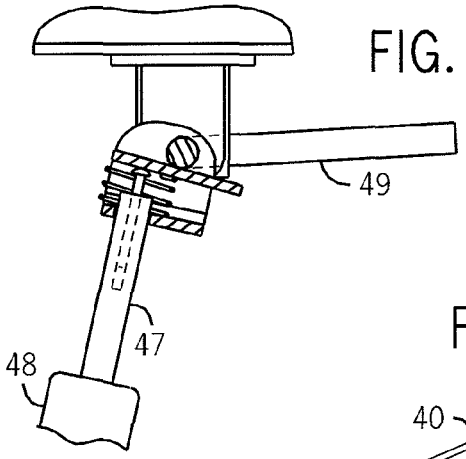
FIG. 8A
FIG. 8
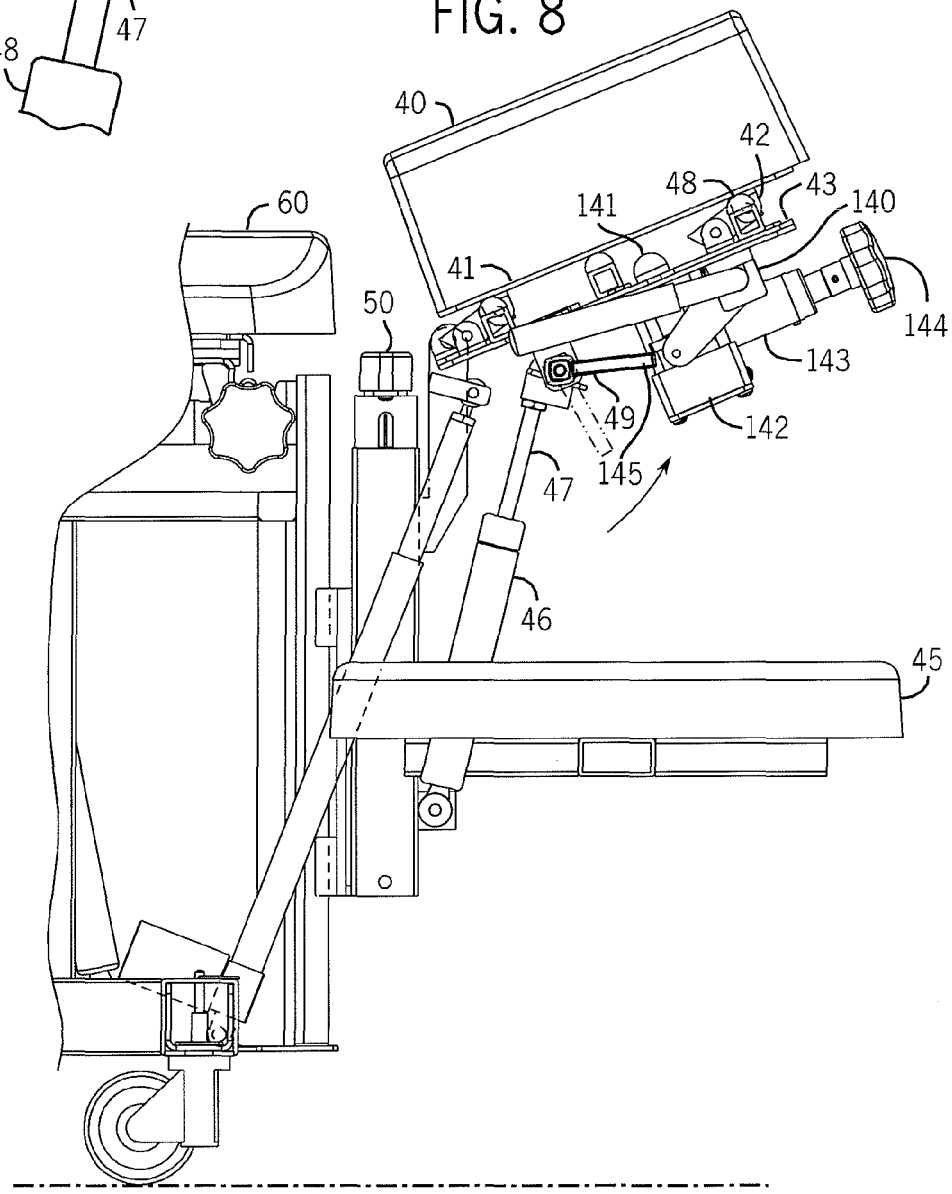

CHIROPRACTIC POSTURE CORRECTION TOOL

This application claims the priority and benefit of U.S. Provisional Patent App. Ser. No. 60/973,798 filed Sep. 20, 2007.

FIELD OF THE INVENTION

The present invention relates generally to chiropractic health care and to devices that are used in the area of chiropractic treatment. More specifically, the present invention relates to an improved posture correction tool in the form of a novel table that is used by chiropractic practitioners to treat mechanical disorders of the spine and musculoskeletal system.

BACKGROUND OF THE INVENTION

Chiropractic health care is well known. Chiropractic health care focuses on disorders of the musculoskeletal system and its related nervous system, and the effects that such disorders have on a patient's general health and well-being. Doctors of Chiropractic, alternatively referred to as "chiropractors" or "chiropractic physicians," practice a drug-free, hands-on approach to health care that includes patient examination, diagnosis and treatment. The most common treatment and therapeutic procedure performed by chiropractors on patients is known as "spinal manipulation" or "chiropractic adjustment." Chiropractic manipulation or adjustment is a manual procedure whereby the chiropractor uses his or her hands to manipulate the joints of the body, particularly the spine, in order to reduce pain and restore or enhance joint function. Manipulation is generally a painless procedure that works by restoring normal joint function and position, and is a safe and effective treatment. To be therapeutic, the manipulation is directed in a very specific path relative to the joint to be treated. During the treatment, the joint is moderately distracted while a high velocity (i.e. very fast) low amplitude (i.e. relatively shallow) thrust is applied through the joint space to restore normal position and function to that joint.

Chiropractic tables, also known as "adjusting tables," are also well known. When combined with the knowledge, skill and experience of the chiropractor, such tables are successfully used in therapeutic chiropractic manipulation as a means of restoring and enhancing the well-being of the patient. Using such adjusting tables during the performance of therapeutic manipulation, chiropractors are able to successfully manage the biomechanical relationship of the patient's spinal segments in relationship to each other as part of the overall central nervous system, the peripheral nervous system, the protective meningeal barriers and all of the other tissues that are connected to the spinal column. The chiropractic table provides the support means for properly positioning the patient prior to application of the manipulative joint thrust, thus allowing the chiropractor to effectively produce the intended result.

In the experience of this inventor, chiropractic tables of the prior art lack certain functionalities that could assist the chiropractor in the application of his or her treatment of the patient. For example, while such tables may include drop sections for assisting the chiropractor during application of the above-mentioned manipulative joint thrust, which is also known as a "drop adjustment," they are very limited in their use.

Accordingly, it is an object of the present invention to provide an improved posture correction tool in the form of a chiropractic adjusting table that has certain new, useful and non-obvious features including:

1. Flying drops (thoracic and lumbar) in the thoracic and lumbar sections. "Flying drops" are defined as the thoracic and lumbar sections of the table of the present invention which are able to be raised and angled and cocked and dropped in any position. These "flying drops" allow the chiropractor to set up a patient in a specific posture and perform a drop adjustment without adding any incorrect postures. In other words, conventional drops find chiropractors unable to perform a drop without adding an incorrect posture to the patient's spine. In the past, attempts were made to compensate for the lack of "flying drops" by using foam wedges. These wedges, however, rarely allowed for an exacting postural set-up prior to a drop being administered. Therefore, chiropractors were often frustrated with the lack of postural correction results because they were often adding improper postures.

2. Pelvic elevation "flying drop" in the pelvic section. The pelvic section of the table can be raised, cocked, and dropped at any height. Here again, this "flying drop" allows the chiropractor to set up a patient in a specific posture and perform a drop adjustment without adding any incorrect postures. Conventional drops find chiropractors unable to perform a drop without adding an incorrect posture to the patient's spine and attempts were made to compensate for the lack of "flying drops" by using foam wedges. These wedges, however, rarely allowed for an exacting postural set-up prior to a drop being administered. As a result, chiropractors were often frustrated with the lack of postural correction results because they were often adding improper postures.

3. The cervical instrument adjusting fulcrum is a unique feature elevates and rotates in order to provide exact positioning for critical cervical instrument adjusting.

4. A head piece that lowers up to three inches (3") below table horizontal while remaining fully functional in forty-five degree (45°) flexion and extension drop. The unique feature provides chiropractors the ability to have the table compensate for anterior or lateral head translation without adding unwanted postures when performing cervical drop work. Additionally, whether the head piece is raised or lowered, it maintains full functionality in forty-five degree (45°) flexion and extension drops.

5. The use of polyurethane pads, for the first time, provide a predictable rebound during the patient adjustment. In addition, is the polyurethane pad allows, for the first time, for a "pre-stress" to be used just prior to following through with the drop in an adjustment. The polyurethane pads have also allowed flexibility of a futuristic design that includes beveled edges and more of a human form outline for easier on- and off-patient access, as well as easier approach to the table by the chiropractor. Up to this point, chiropractic tables had traditionally been covered with a foam product that was limited in all that was described above.

6. This table was also designed for ease of mobility. It has lift rods at the head and foot of the table. It has wheels that are easily inserted or removed. Aside from portable chiropractic tables, the heavier permanent tables have not been designed with mobility in mind.

7. The table of the present invention was engineered with safety in mind. The majority of conventional "pinch points" have been eliminated.

SUMMARY OF THE INVENTION

The table the present invention has obtained these objects. It was designed to perform certain functions that no other table in the prior art performs. These unique functions require the chiropractic practitioner to essentially "re-learn" how to use the new posture correction tool table of the present invention. For example, the table of the present invention uses polyurethane pads that have been designed with densities to maximize the "pre-stress" that is needed for optimal mechano-reception and thus maximal neurological correction. The table of the present invention also comprises a unique head piece, a unique cervical instrument adjusting fulcrum, unique thoracic and lumbar pieces, and a unique pelvis piece.

The head piece in the table of the present invention is raised and lowered electrically. While the table remains horizontal, the head piece can be lowered a distance below the thoracic piece or can be raised a distance above it as well. The head piece thus allows for flexion and extension of the patient's head. The head piece can be moved up to an unprecedented height of about 8 inches and be fully usable as a "cock and drop" piece from any vertical position while also extending up to about forty-five degree (45°) in both flexion and extension at any given vertical position of the head piece. The head piece used in the table of the present invention can also be favored, or biased, to drop cephalad or caudad. The head piece includes a tension setting having a tension knob that covers the full spectrum of tension in just two and one-quarter turns. On the lowest tension setting, the weight of the individual table pads, themselves, is enough to cause that section to drop. At its highest tension setting, the relevant table pad requires a high amount of force to get the section to drop. It does not require much rotation of the sensitive tension knob to create a great change in tension setting.

The cervical instrument adjusting fulcrum in the table of the present invention is a feature that elevates and rotates in order to provide exact positioning for critical cervical instrument adjusting.

The thoracic and lumbar pieces in the table of the present invention include thoracic and lumbar drops that are mounted on a single plate and can be raised to fifty-five degrees)(55°) above horizontal. The thoracic drop is a "flying drop," which means that the thoracic piece can be cocked and dropped at an angle. The table of the present invention can be equipped with a standard lumbar handle-cocking device, the lumbar piece also being a flying drop mechanism. The table may alternatively be equipped with an optional lumbar foot pedal cocking device wherein the flying drop is replaced with a lumbar drop that only functions in the horizontal position.

The pelvic piece in the table of the present invention is equipped with a standard pelvic-hinged drop which is either cocked with the standard handle-cocking device or optional foot pedal-cocking device. If the table is equipped with the optional pelvic elevation, it will come with a foot pedal-cocking device only and is a flying drop which can be cocked and dropped in any position. The manually operated optional pelvic elevation piece elevates approximately eight inches (8") above horizontal.

Finally, the table of the present invention utilizes polyurethane pads that will not lose the integrity of their density as compared to upholstered foam pads. The densities of the pads have been designed to maximize the "pre-stress" needed for optimal mechano-reception and thus maximal neurological correction. Therefore, the practitioner needs to apply a force to the spine to take up slack in the polyurethane while following through to complete a drop.

The foregoing and other features of the table of the present invention will be apparent from the detailed description that follows.

BRIEF DESCRIPTION OF THE DRAWINGS

FIG. 8 is a view similar to those illustrated in FIGS. 5 and 7 but showing the head piece portion in an upwardly angled position.

FIG. 8A is an enlarged cross-sectioned view of a portion of the head piece support structure shown in FIG. 8.

DETAILED DESCRIPTION

Figure 1:
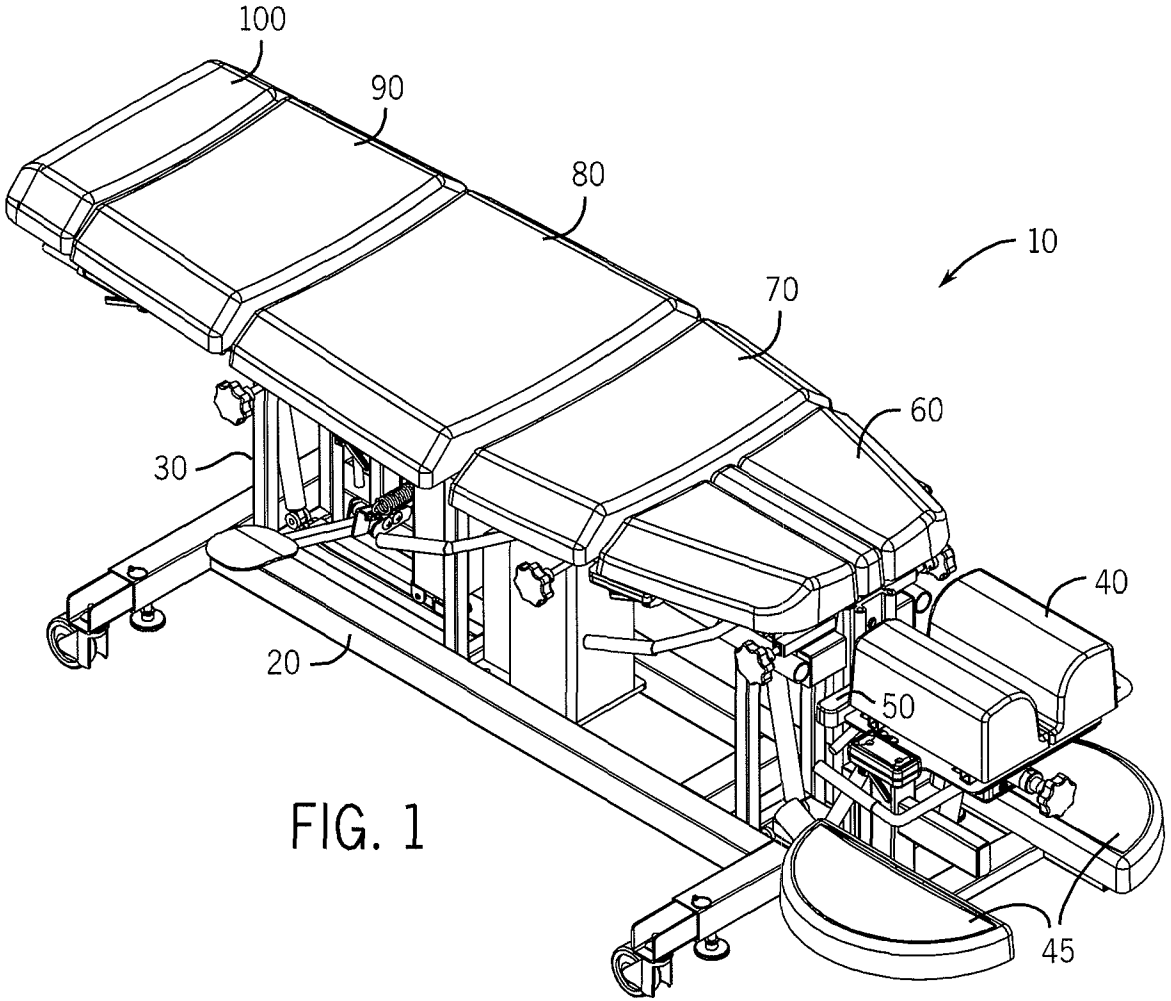
FIG. 1 is a front, left side and top perspective view of a table constructed in accordance with the present invention.

Referring now to the drawings in detail, wherein like numbered elements refer to like elements throughout, FIGS. 1 through 4 illustrate a representative structure, generally identified 10, which is a preferred embodiment of a posture correction tool table that is constructed in accordance with the present invention. Generally speaking, the table 10 comprises a plurality of pads that are mounted onto a superstructure. It is this plurality of pads that support the patient during chiropractic treatment. More specifically, and moving from that forward-most point of the table 10 where the patient's head (not shown) would rest, it will be seen that the pads comprise a head pad 40, a cervical pad 50, a composite thoracic pad 60, a lumbar pad 70, a pelvic pad 80, a leg pad 90, and a foot pad 100. Additionally, two semi-circular shaped arm pads 45 are located and mounted to either side of the head pad 40. This allows the patient, who is supported in the prone position by the table 10, to rest his or her arms on the arm pads 45 during chiropractic treatment.

Figure 2:
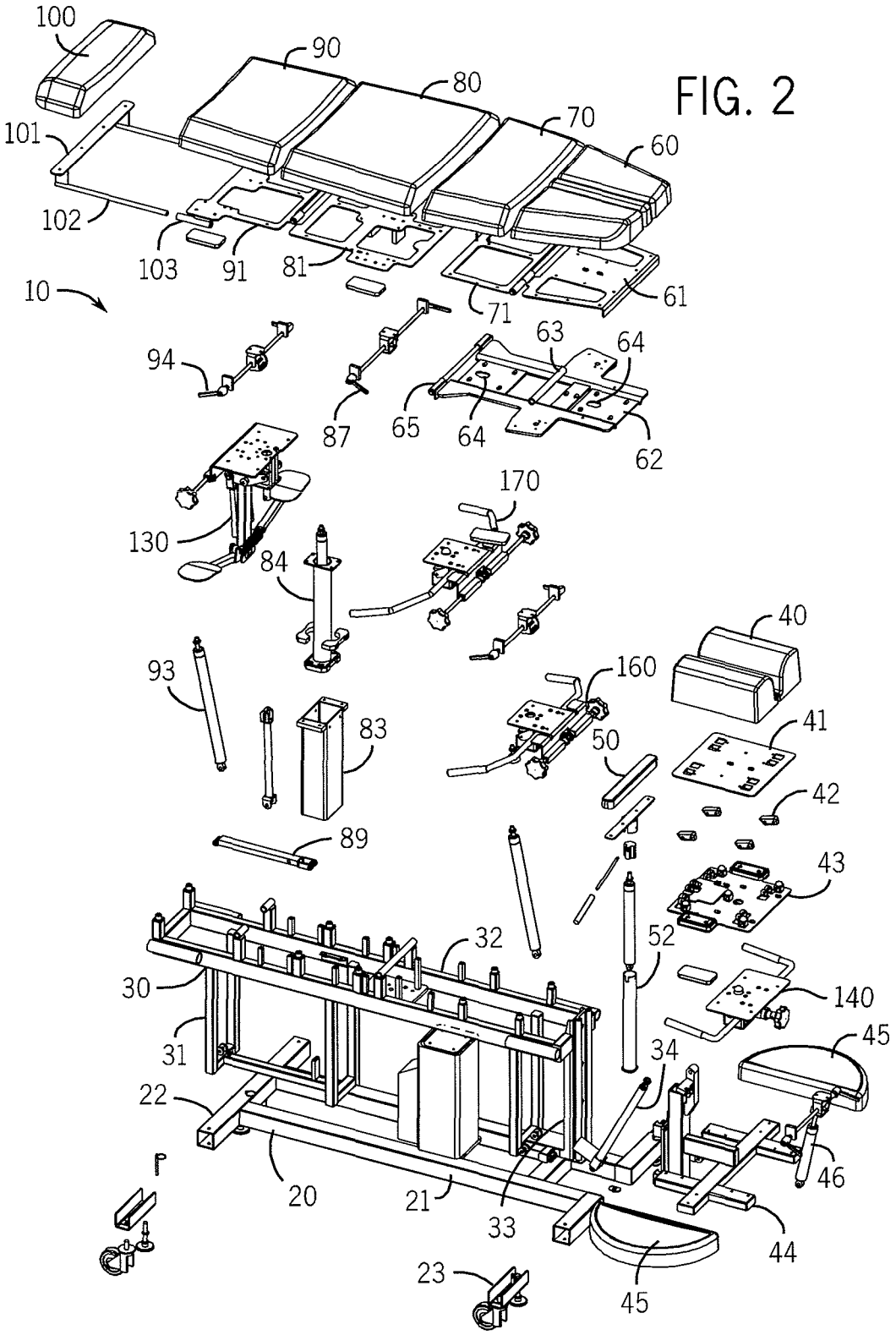
FIG. 2 is an exploded front, left side and top perspective view of the table illustrated in FIG. 1.
Figure 3:
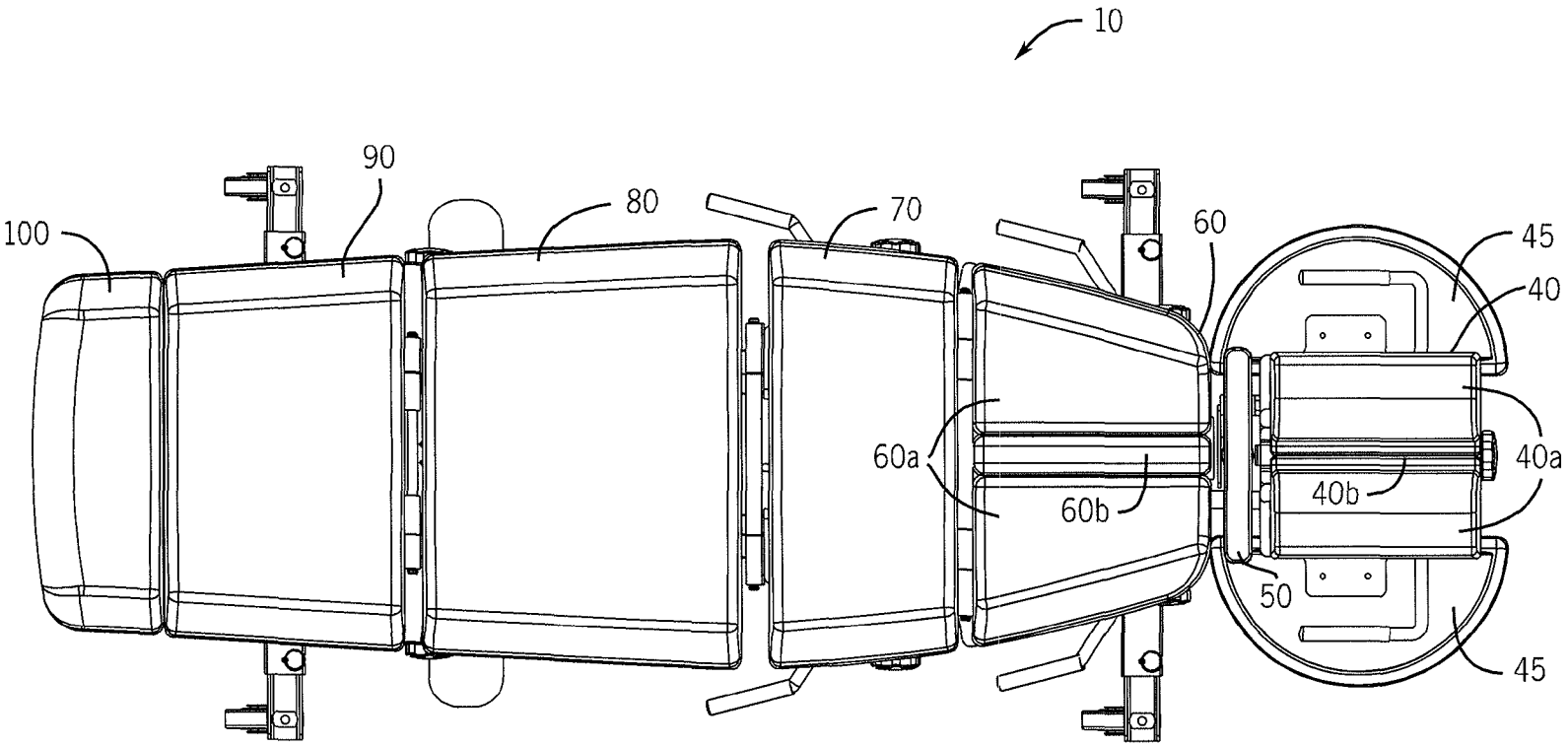
FIG. 3 is a top plan view of the table illustrated in FIG. 1.
Figure 4:
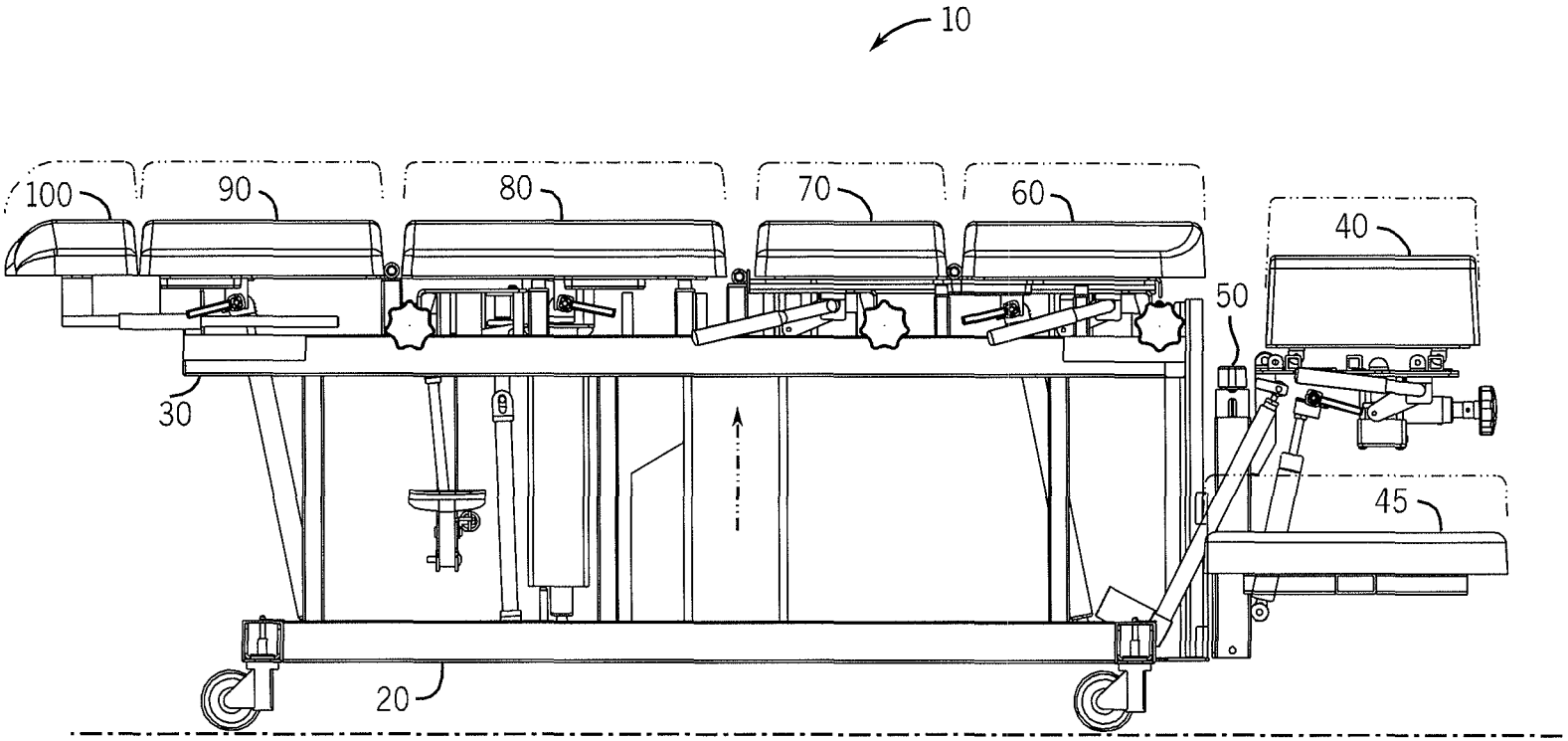
FIG. 4 is a left side elevational view of the table illustrated in FIG. 1.
Figure 6:
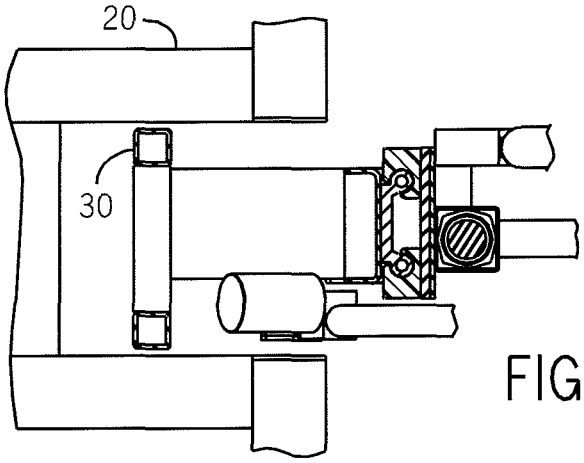
FIG. 6 is a partially sectioned top plan view of the forward-most portion of the bottom frame taken along line 6-6 of FIG. 5.

As shown in FIG. 2, the table 10 comprises a supporting super-structure generally comprising a bottom frame 20 and a top frame 30. The bottom frame 20 comprises a plurality of longitudinally-extending bottom frame members 21 and a plurality of integrally-attached, transversely-extending bottom frame members 22. The transversely-extending bottom frame members 22 each include castor/support subassemblies 23. The castor/support subassemblies 23 provide for ease of mobility of the table 10 as may be desired or required. The top frame 30 comprises a plurality of vertically-disposed top frame members 31 and plurality of integrally-attached, longitudinally-extending top frame members 32. A rail 33 is disposed forwardly of the top frame 30, the purpose of which will be apparent later in this detailed description. The last part of the supporting super-structure of the table 10 of the present invention is the head pad frame 44.

Figure 5:
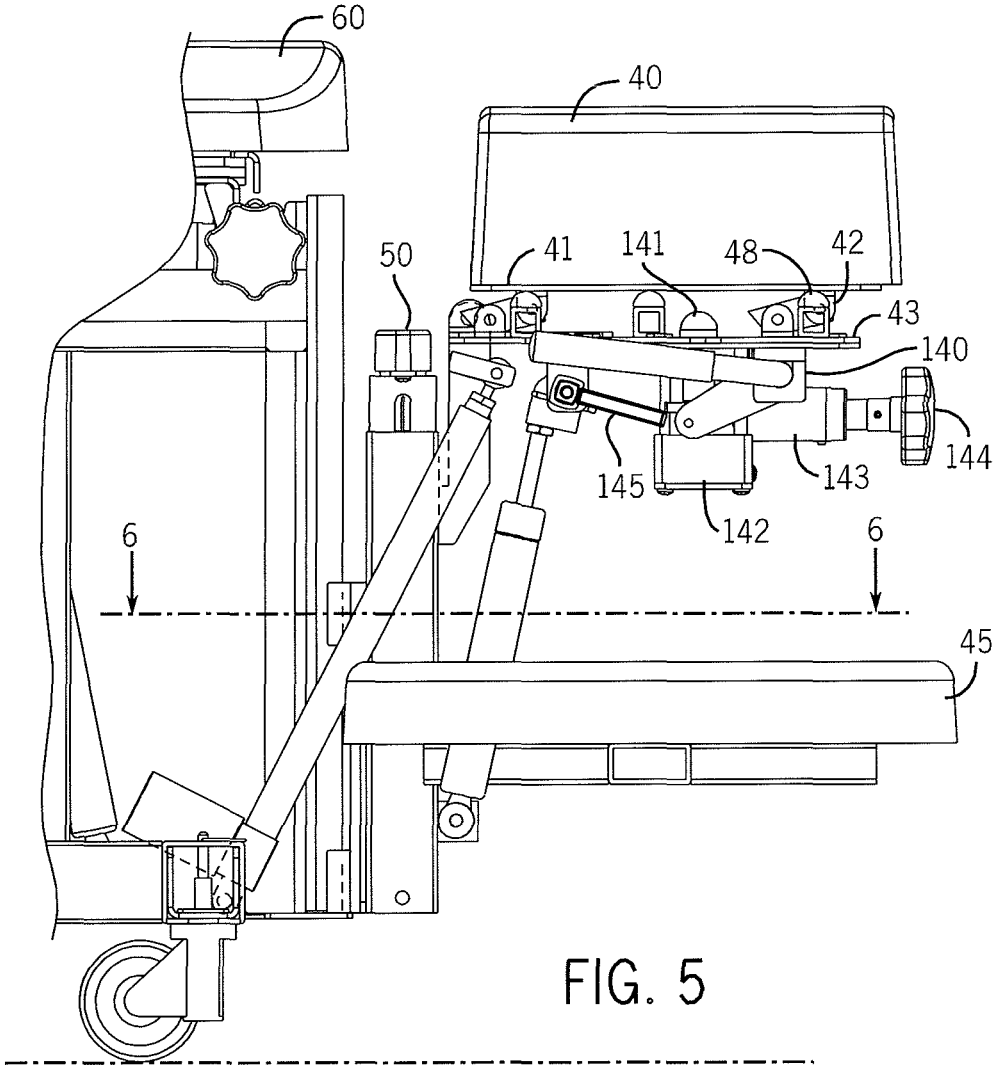
FIG. 5 is an enlarged partial left side elevational view of the head piece portion of the table illustrated in FIG. 4 and showing the head piece portion in its lowest position.
Figure 7:
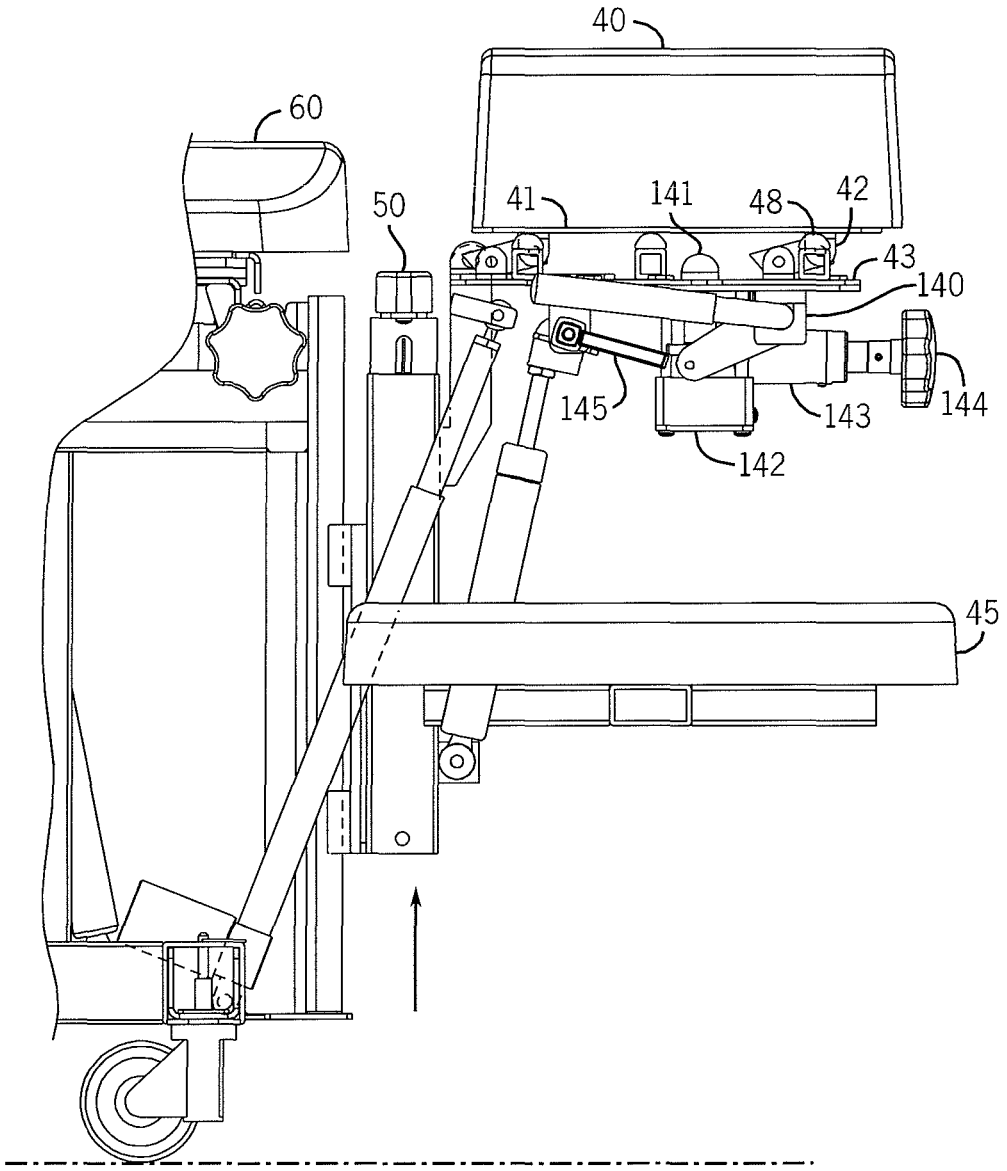
FIG. 7 is the same view illustrated in FIG. 5 but showing the head piece portion in its highest position.
Figure 9:
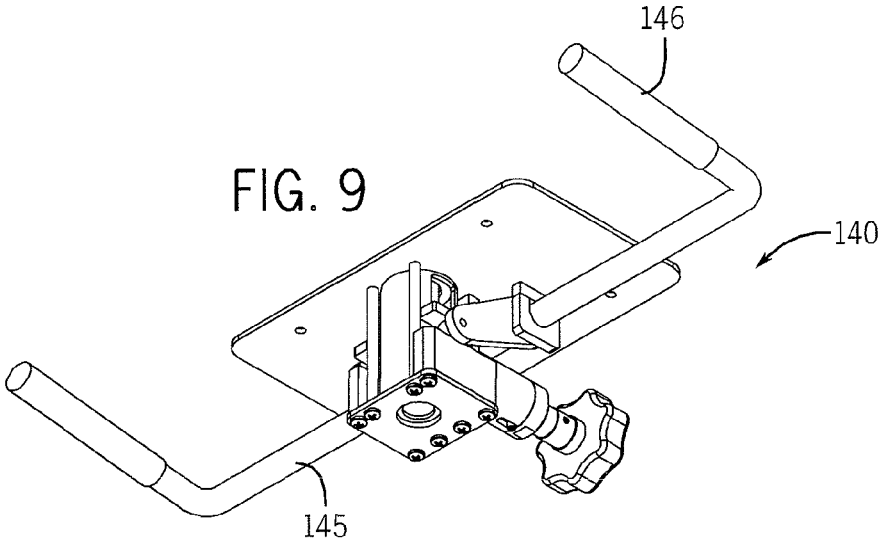
FIG. 9 is a bottom, left side and rear view of the handle-cocking assembly that is used in the head piece portion of the table of the present invention.
Figure 11B:
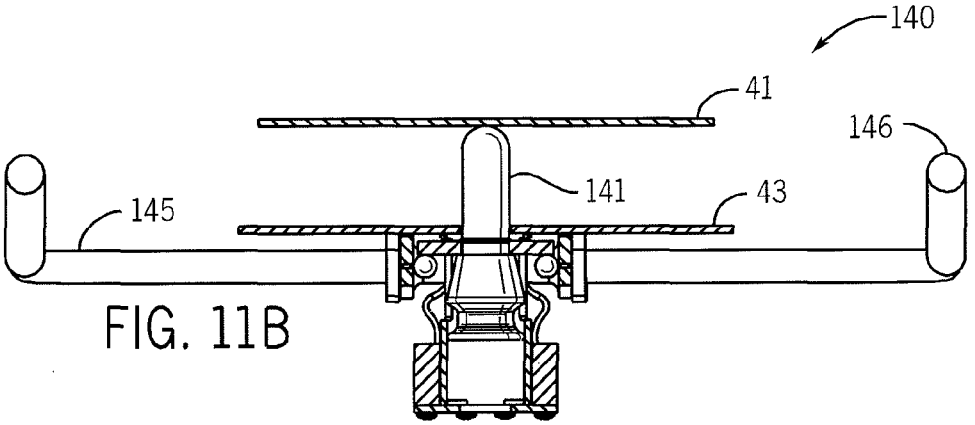
FIG. 11B is a partially sectioned rear elevational view of the handle-cocking assembly that is illustrated in FIG. 9 and showing the head piece drop pin in the position that it is in as shown in FIG. 11A.

The head pad 40 is a structure comprised of opposing outer pad portions 40*a* defining a central groove 40*b*. See FIG. 3. The head pad 40 is secured to a head pad plate 41 which is in turn attached to a top drop plate 43 by means of a plurality of cervical drop links 42. Again, see FIG. 2. A plurality of dome-shaped bumpers 48 are attached to the top drop plate 43 for cushioning. See also FIG. 7. The top drop plate 43 is attached to a portion of the head pad frame 44. Attached to the top drop plate 43 is the head and cervical drop sub-assembly 140. Refer again to FIG. 2. The head pad 40 is raised and lowered electrically. While the table 10 remains horizontal, the head pad 40 in the preferred embodiment and its related structures can be lowered three inches (3") below the thoracic pad 60 or raised eight inches (8") above the thoracic pad 60. See FIGS. 5 and 7, for example. This range of movement is accomplished by means of a carriage 34 that is attached to the head pad frame 44 and which is slidably and vertically movable along the rail 33. This is accomplished by actuation of the ball drive 35 and ball screw 36.

Referring now to FIGS. 9, 10A, 10B, 11A and 11B, it will be seen that the head and cervical drop subassembly 140 comprises a drop pin 141, a lever bottom stop 142, a tension tube 143 and a tension knob 144. To manually "cock" the head pad 40 and its related structure, the practitioner pulls upwardly on one end 146 of the cocking bar or lever 145. It is to be understood that the table 10 of the present invention can be configured such that the head pad 40 can be favored to drop cephalad (towards the forward portion of the table 10) or caudad (towards the rearward portion of the table 10), depending upon the treatment that is desired or required.

Figure 10B:
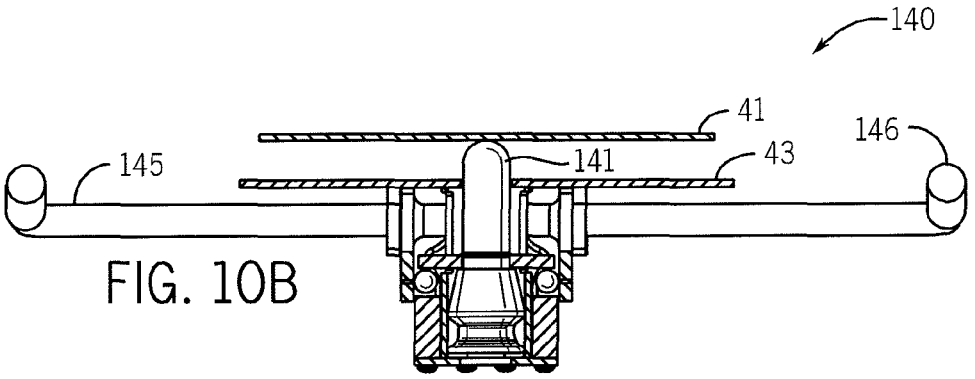
FIG. 10B is a partially sectioned rear elevational view of the handle-cocking assembly that is illustrated in FIG. 9 and showing the head piece drop pin in the position that it is in as shown in FIG. 10A.
Figure 10A:
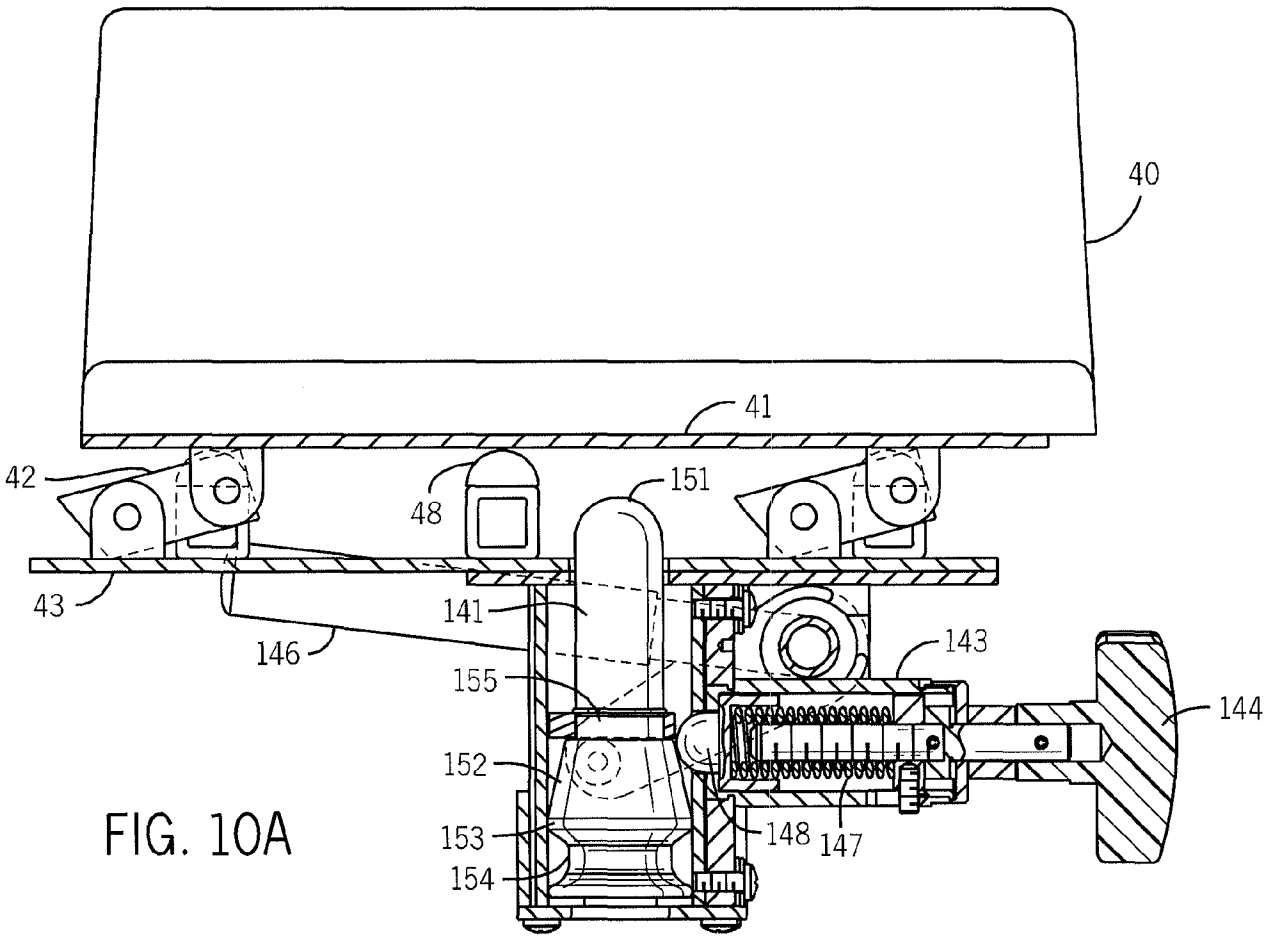
FIG. 10A is a partially sectioned left side elevational view of the head piece portion and showing the head piece drop pin in its "post-drop" position.
Figure 11A:
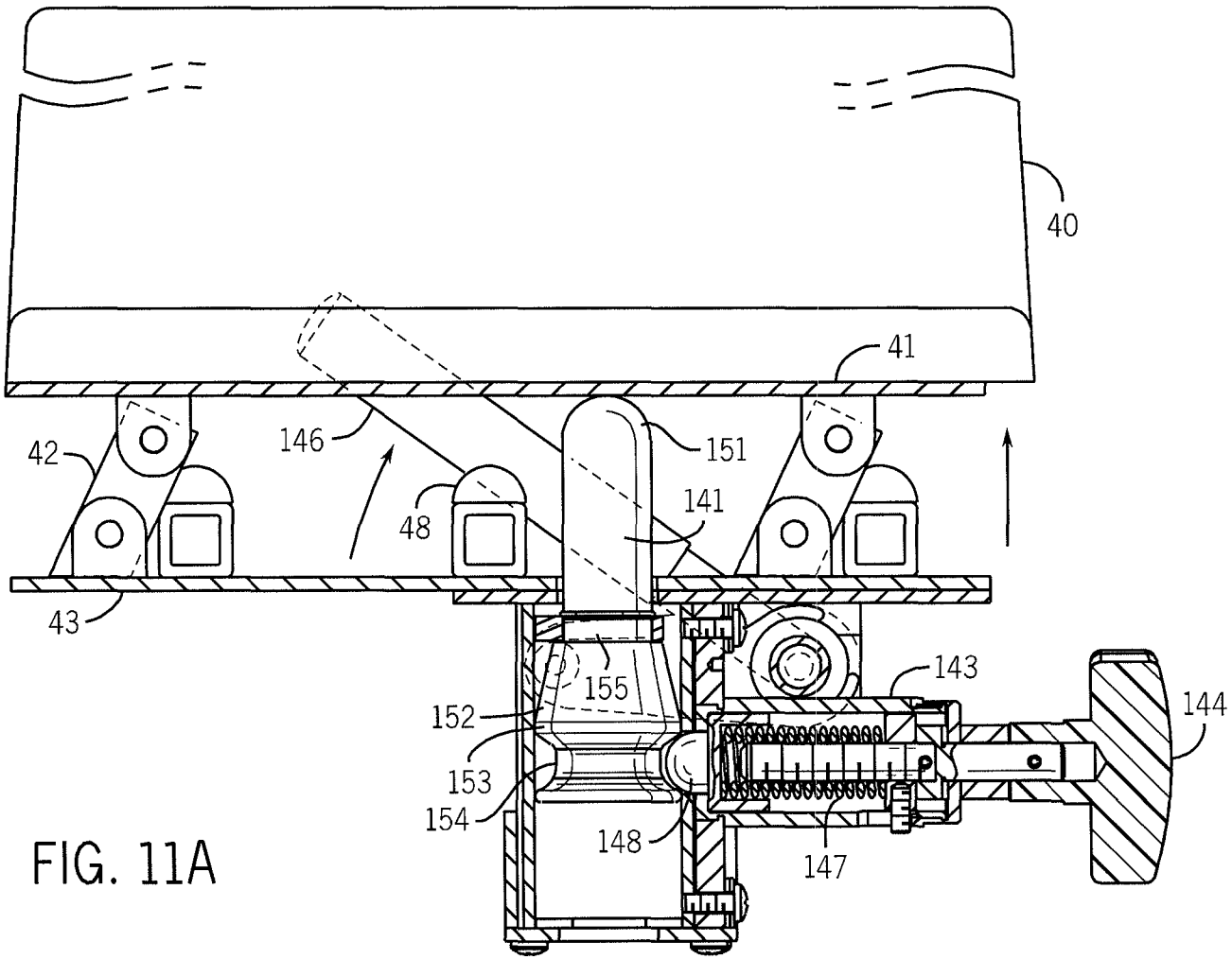
FIG. 11A is a partially sectioned left side elevational view of the head piece portion and showing the head piece drop pin in its "pre-drop" or "cocked" position.

As is illustrated in much greater detail in FIGS. 10A and 11A, it will be seen that the tension tube 143 houses a tensioning spring 147 that biases a release member 148 against the drop pin 141. Specifically, the drop pin 141 comprises a cylindrically-shaped and dome-topped upper portion 151 and a circumferential and outwardly tapered bottom portion 152, the bottom portion 152 terminating in a circumferential ridge 153 and capture groove 154. As the practitioner raises the end 146 of the cocking bar or lever 145, as shown in FIG. 11A, the drop pin 141 is elevated by means of a plate that engages a collar portion 155 of the drop pin 141. In this motion, the upper portion 151 of the drop pin 141 urges the head pad plate 41 upwardly to the pre-drop position shown. In this position, the release member 148 housed within the tension tube 143 is "captured" within the groove 154 of the drop pin 141. This position is maintained until a downward force is exerted on the head pad 40 thereby urging the drop pin 141 downwardly and causing the release member 148 to be pushed into the tension tube 143 and out of the groove 154 of the drop pin 141.

At this point, it should be mentioned that the tension knob 144 covers the full spectrum of tension in just two and a quarter turns. On the lowest tension setting, the weight of the head pad 40 and its plate 41 is enough to cause the head pad 40 to drop. At its highest tension setting, the head pad 40 requires a high amount of force to get the section to drop. It does not require much rotation of the sensitive tension knob 144 to create a great change in tension setting. This functionality is also present in other portions of the table 10, 12 will be apparent later in this detailed description, like tension knobs being bilateral, however.

Referring now to FIG. 8, for example, it will be seen that the head pad 40 can also be moved upwardly or downwardly to allow for flexion and extension of the head pad 40 relative to the horizontal. In the table 10 of the present invention, the head pad 40 can be moved upwardly and downwardly relative to the horizontal and can also be positioned angularly to an unprecedented forty-five degrees (45°) in both flexion and extension. This movement is accomplished by use of the release lever 49 disposed to one side of a hydraulic tube or cylinder 46, which use extends or retracts the rod 47 within the tube 46. See FIG. 8A. More specifically, when the lever 49 is depressed upwardly, it releases the rod 47 of the gas cylinder 46 to quietly and smoothly raise, lower or angle and lock the head pad 40. This functionality is present in other portions of the table 10 as well, as will be apparent later in this detailed description.

Figure 12:
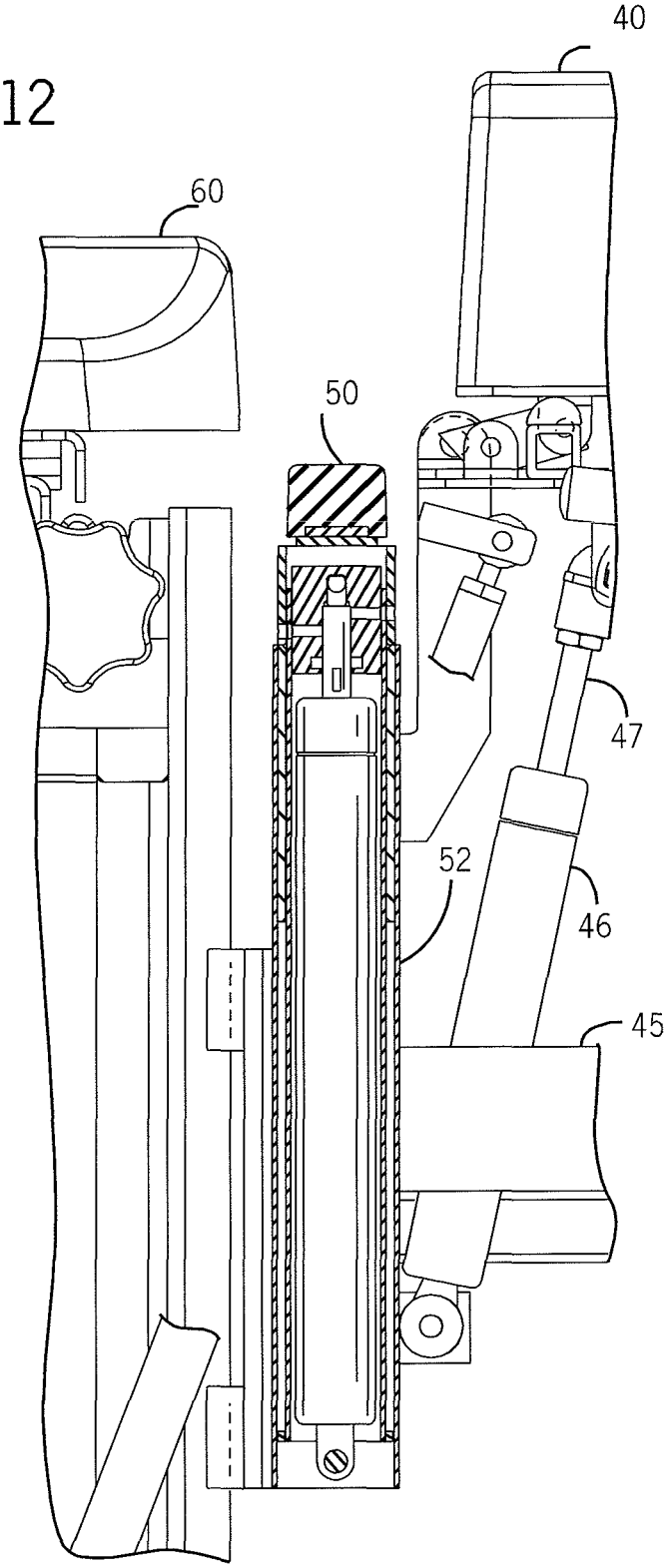
FIG. 12 is a further enlarged left side elevational view of the cervical pad assembly in the table of the present invention and showing the cervical pad in its lowest vertical position relative to the table.
Figure 13:
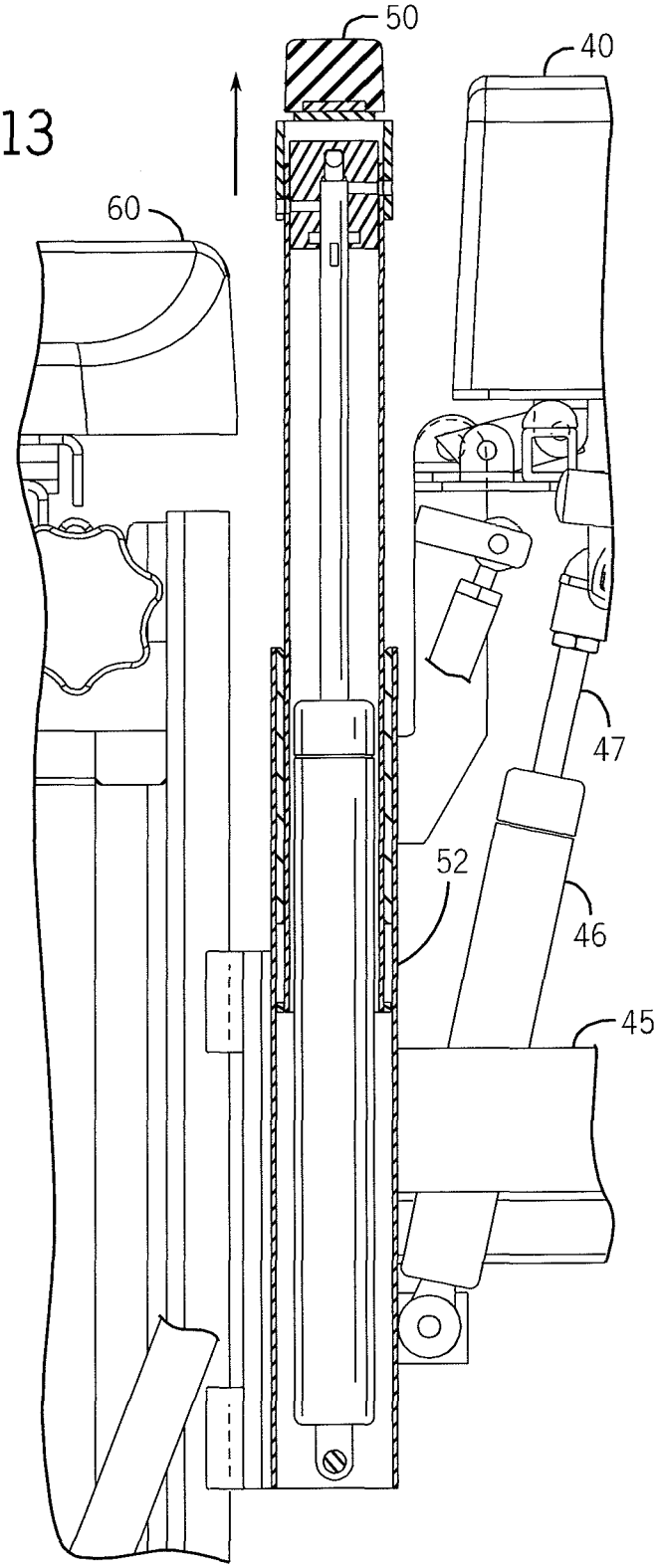
FIG. 13 is a view similar to that illustrated in FIG. 12 and showing the cervical pad in its highest vertical position relative to the table.

The table 10 of the present invention also comprises a cervical instrument adjusting fulcrum in the form of a cervical pad 50, the cervical pad 50 being supported by and rotatably mounted about a vertically-adjustable structure 52. See FIGS. 12 and 13. The cervical instrument adjusting fulcrum that is utilized in the table 10 of the present invention is unique. To the knowledge of this inventor, no other table of past or current manufacture includes this structure. Use of this structure allows the chiropractor the ability to create the exact patient posture that is necessary in order to utilize impulse adjusting instruments to correct postural positioning of the patient. One such instrument is disclosed and claimed in U.S. Pat. No. 7,144,417 issued to Colloca et al. During usage of such an instrument with the adjusting fulcrum and cervical pad 50, the patient is positioned on his or her side with the patient's neck being properly positioned for instrumental stimulation. Prior to this innovation, chiropractors would resort to supporting the patient's neck with pillows, wedges or some combination of both. Use of the adjustable cervical pad 50 is novel and unprecedented.

Figure 15:
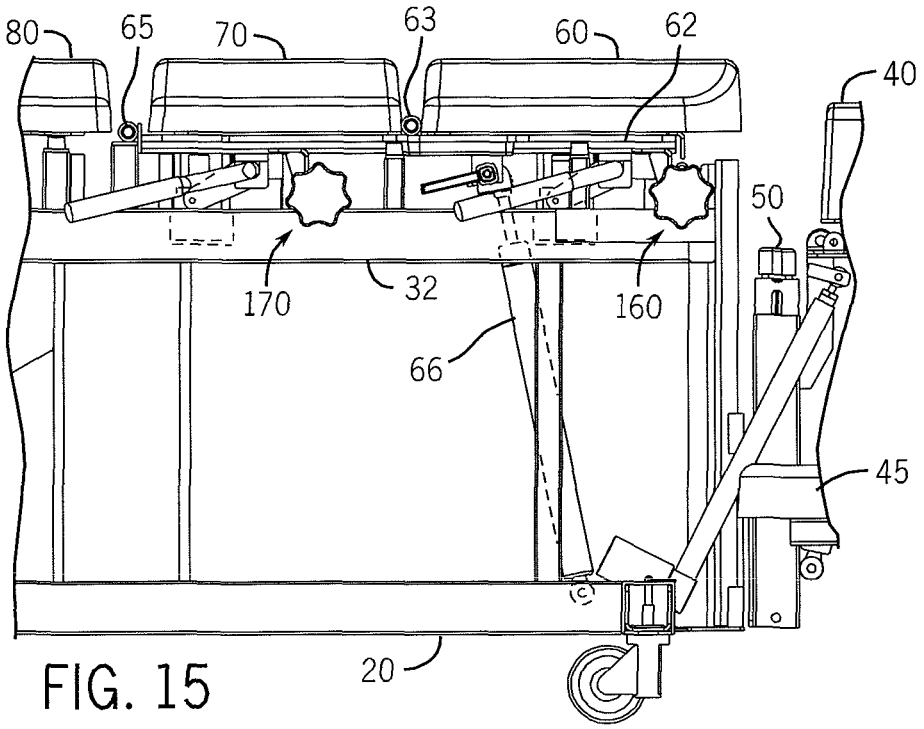
FIG. 15 is a partial left side elevational view of the lumbar and thoracic portion of the table illustrated in FIG. 4 and showing the lumbar and thoracic portion in its fully "down" position.
Figure 16:
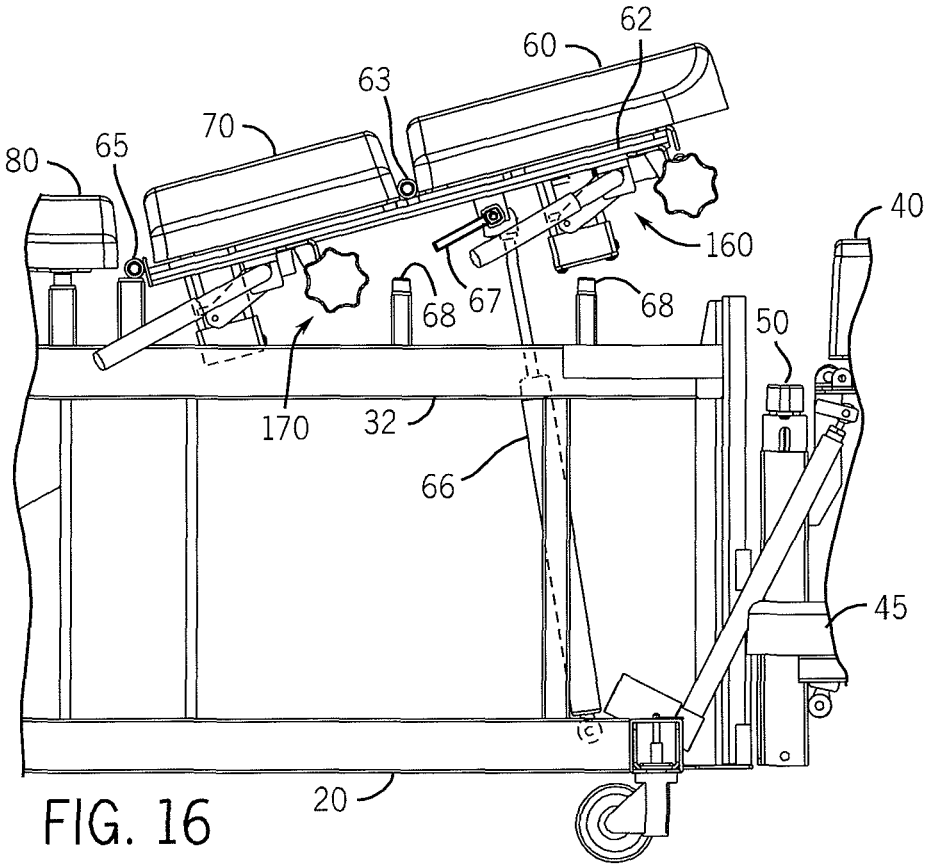
FIG. 16 is a view similar to that illustrated in FIG. 15 and showing the lumbar and thoracic portion in a "raised" position.
Figure 17:
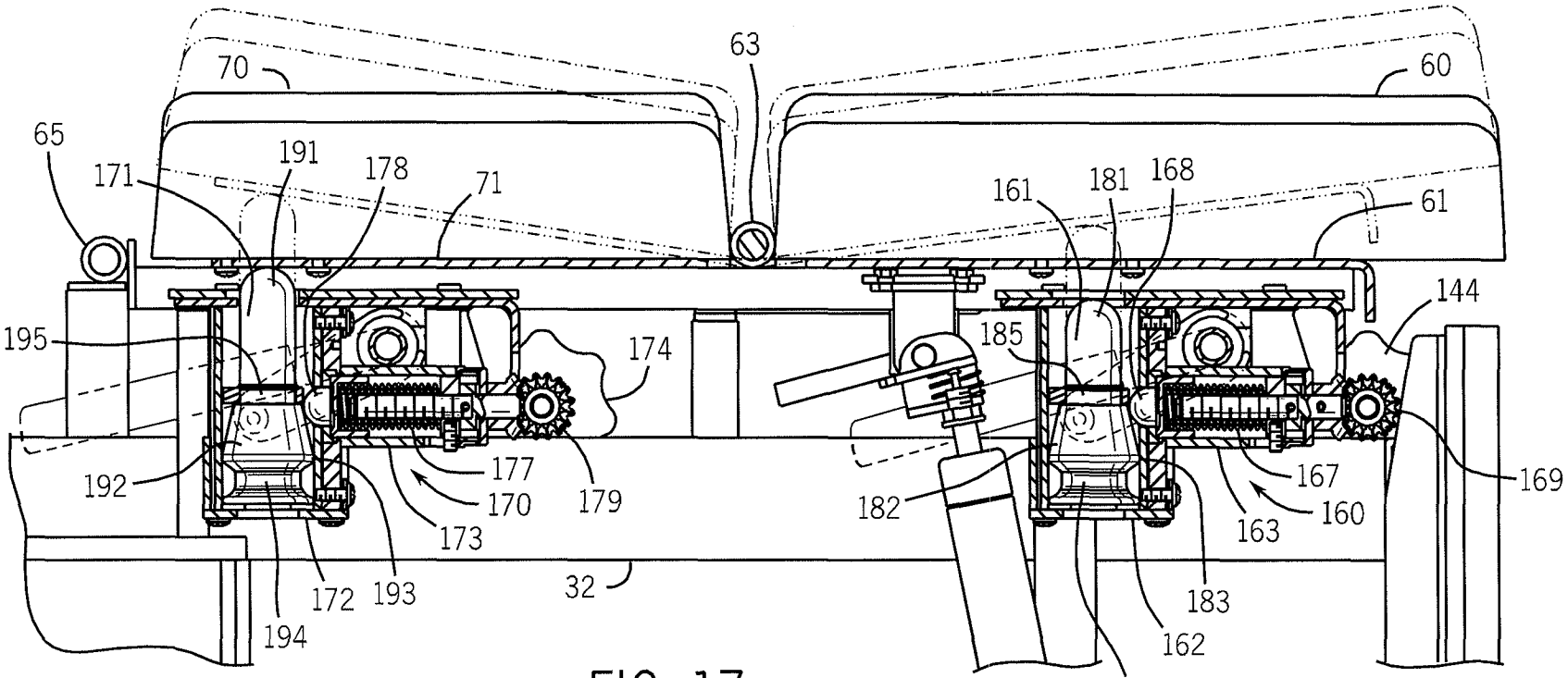
FIG. 17 is a further enlarged left side elevational view of the lumbar and thoracic portion of the table illustrated in FIGS. 15 and 16 and showing, in phantom view, the respective drop pin assemblies used with that portion.

Referring again to FIGS. 1 through 4, it will be seen that the thoracic pad 60 is comprised of opposing outer pad portions 60*a* and a central pad portion 60*b*. The next adjacent pad is the lumbar pad 70. See also FIG. 15. Referring specifically to FIGS. 1, 16 and 17, it will be seen that the thoracic pad 60 is attached to a thoracic pad plate 61 and that the lumbar pad 70 is attached to a lumbar pad plate 71. The thoracic pad plate 61 and the lumbar pad plate 71 are each attached to a single "common" thoracic-lumbar support plate 62. The common thoracic-lumbar support plate 62 is hingedly attached to a portion of the top frame 30 by means of a primary hinge 65. A secondary hinge 63 is also provided to allow the thoracic pad plate 61 and the lumbar pad plate 71 to each rotate upwardly from the common thoracic-lumbar support plate 62 at the secondary hinge 63. See FIG. 17.

As shown in FIG. 16, the common thoracic-lumbar support is plate 62 is rotatable about the primary hinge 65. Elevation of the common thoracic-lumbar support plate 62 is accomplished by actuation of the hydraulic tube 66 via the bilateral lever 67. The functionality of this hydraulic tube 66 is essentially identical to that of the hydraulic tube 46 that is used with the head pad 40 and its related structure. The hydraulic tube 67 that is attached to the common thoracic-lumbar support plate 62 allows the plate 62 to be raised up to fifty-five degrees)(55°) above the horizontal. A plurality of bumpers 68 are disposed between the common thoracic-lumbar plate 62 and the top frame 30 to cushion the return of the plate 62 to the horizontal.

Referring again to FIG. 1, it will be seen that the common thoracic-lumbar plate 62 has a plurality of apertures 64 defined in it. The purpose of the apertures 64 is to allow for access to the thoracic pad plate 61 and to the lumbar pad plate 71 from below. Situated below each of these plates 61, 71 is a thoracic drop subassembly 160 and a lumbar drop subassembly 170, respectively.

Referring again to FIG. 17, it will be seen that the thoracic drop subassembly 160 comprises a drop pin 161, a lever bottom stop 162, a tension tube 163, a pair of bilateral tension knobs 144 (see FIG. 14) and a miter gear assembly 169. To manually "cock" the thoracic pad 60 and its related structure, the practitioner pulls upwardly on one end 166 of the bilateral cocking bar or lever 165. See also FIG. 14. It will also be seen that the tension tube 163 houses a tensioning spring 167 that biases a release member 168 against that drop pin 161. The drop pin 161 comprises a cylindrically-shaped and dome-topped upper portion 181 and a circumferential and outwardly tapered bottom portion 182, the bottom portion 182 terminating in a circumferential ridge 183 and capture groove 184. As the practitioner raises the end 166 of the bilateral cocking bar or lever 165, the drop pin 161 is elevated by means of a plate that engages a collar portion 185 of the drop pin 161. In this motion, the upper portion 181 of the drop pin 161 urges the thoracic pad plate 61 upwardly to the pre-drop position shown in phantom view in FIG. 17. In this position, the release member 168 housed within the tension tube 163 is captured within the groove 184 of the drop pin 161.

As is also shown in FIG. 17, the table 10 of the present invention further comprises a lumbar drop sub-assembly 170. The lumbar drop sub-assembly 170 comprises a drop pin 171, a lever bottom stop 172, a tension tube 173, a pair of bilateral tension knobs 174 (see FIG. 14) and a miter gear assembly 179. To manually "cock" the lumbar pad 70 and its related structure, the practitioner pulls upwardly on one end 176 of the cocking bar or lever 175. It will also be seen that the tension tube 173 houses a tensioning spring 177 that biases a release member 178 against the drop pin 171. This drop pin 171 again comprises a cylindrically-shaped and dome-topped upper portion 191 and a circumferential and outwardly tapered bottom portion 192, the bottom portion 192 terminating in a circumferential ridge 193 and capture groove 194. As the practitioner raises the end 176 of the cocking bar or lever 175, the drop pin 171 is elevated by means of a plate that engages a collar portion 195 of the drop pin 171. In this motion, the upper portion 191 of the drop pin 171 urges the lumbar pad plate 71 upwardly to the pre-drop position shown in phantom view in FIG. 17. In this position, the release member 178 housed within the tension tube 173 is captured within the groove 194 of the drop pin 171.

Figure 14:
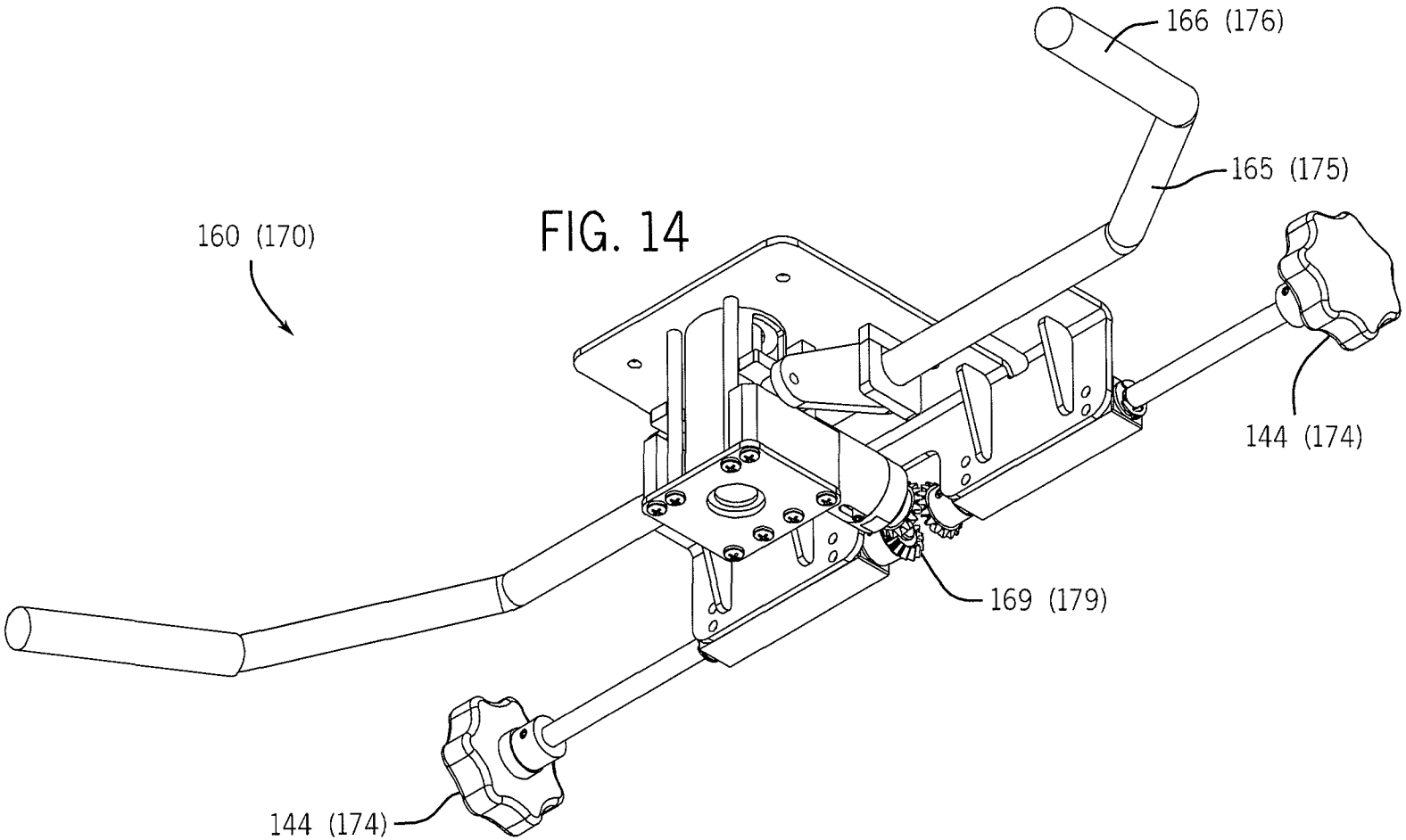
FIG. 14 is a bottom, left side and rear view of the handle-cocking assembly that is used in the lumbar and thoracic portion of the table of the present invention.

It should again be mentioned here that the tension knobs 164, 174 illustrated in FIG. 14 cover the full spectrum of tension in just two and a quarter turns. On the lowest tension setting, the weight of the respective pads 60, 70 and their plates 61, 71 is enough to cause the pads 60, 70 to drop. At their highest tension setting, the pads 60, 70 require a high amount of force to effect a drop. It does not require much rotation of the sensitive tension knobs 164, 174 to create a great change in tension setting.

The table 10 of the present invention further comprises a pelvic pad 80. See FIGS. 3, 4 and 19 through 21 in this regard. As shown, the pelvic pad 80 is supported by and attached to a pelvic pad plate 81. The pelvic pad plate 81 is attached to a drop bracket 82. Disposed vertically below the drop bracket 82 is a pelvic column outer-housing 83 and a pelvic column inner-housing 84. The inner-housing 84 is slideably moveable within the outer-housing 83. Disposed within the outer and inner-housings 83, 84 is a hydraulic tube 86 that is actuated by a lever 87. A plurality of bumpers 88 are mounted to the top frame 30 to provide cushioning for the pelvic pad plate 81 when the pelvic pad plate 81 is dropped or lowered to its bottom-most position.

Figure 18:
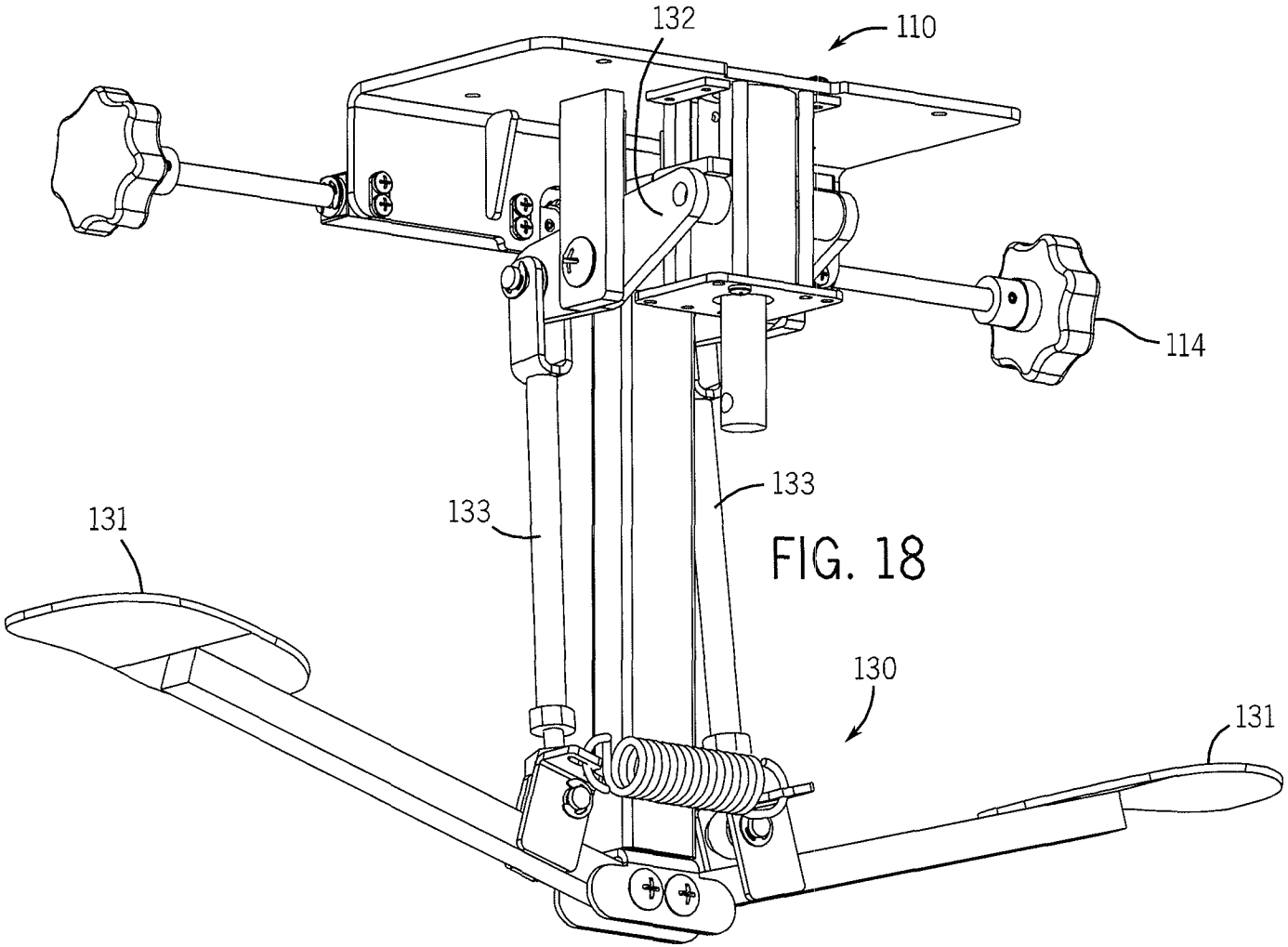
FIG. 18 is an enlarged front, left side and bottom perspective view of the foot pedal-cocking assembly used in the pelvic portion of the table illustrated in FIG. 4.
Figure 19:
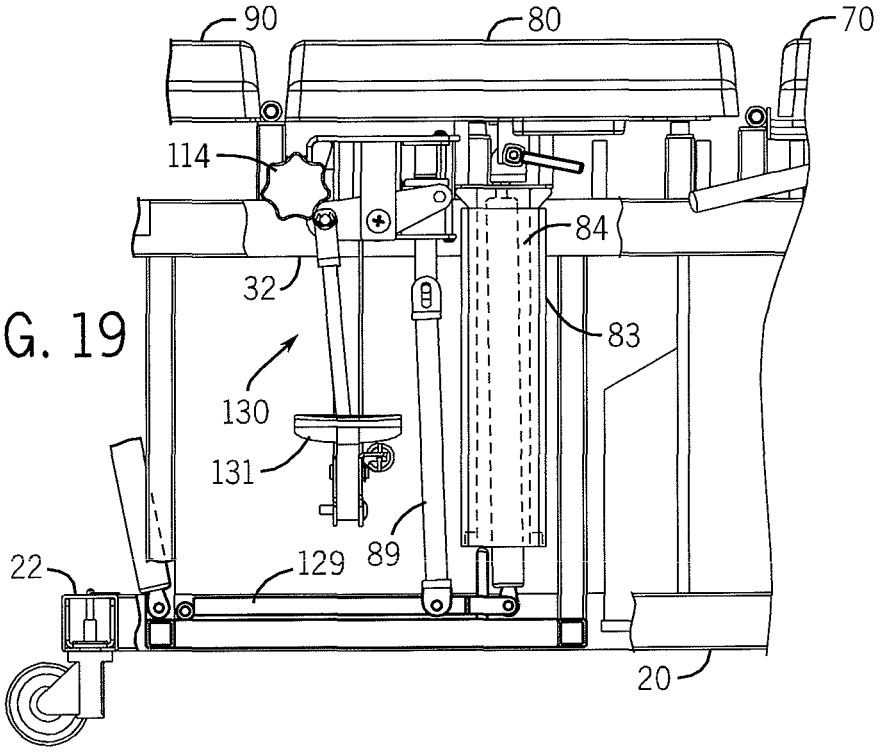
FIG. 19 is a partial left side elevational view of the pelvic portion of the table illustrated in FIG. 4 and showing the pelvic portion in its fully "down" position.
Figure 20:
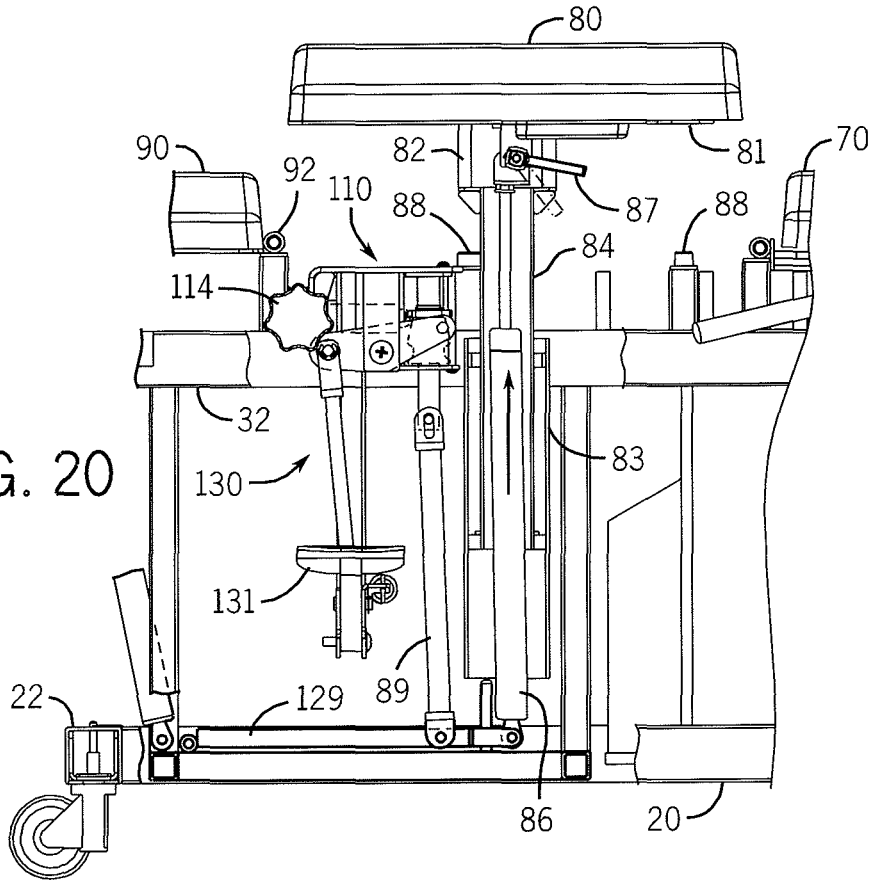
FIG. 20 is a view similar to that illustrated in FIG. 19 and showing the pelvic portion in a "raised" position.
Figure 21:
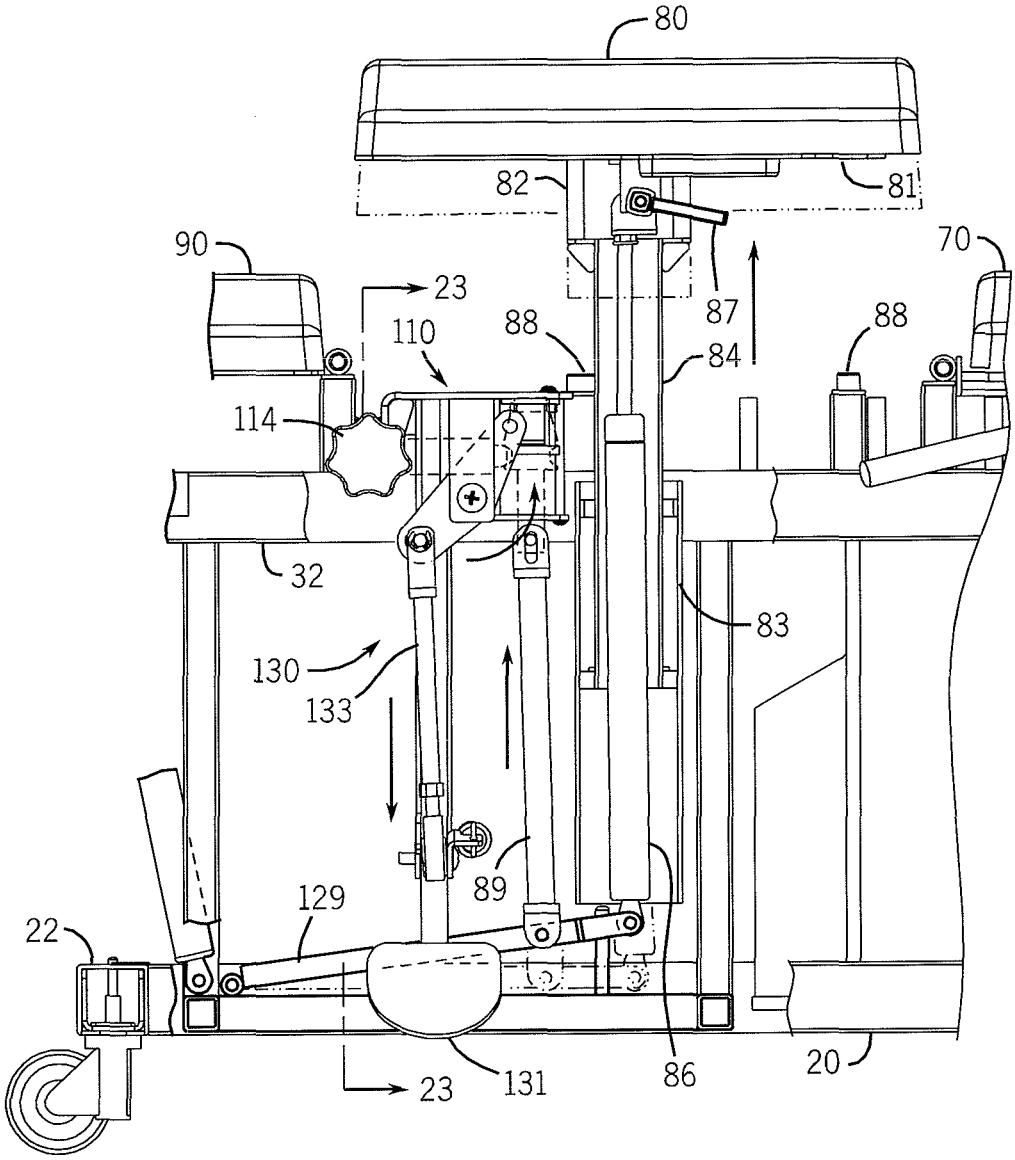
FIG. 21 is a further enlarged view similar to that illustrated in FIG. 20 and showing relative movement of the foot pedal-cocking assembly and of the pelvic column.
Figure 22:
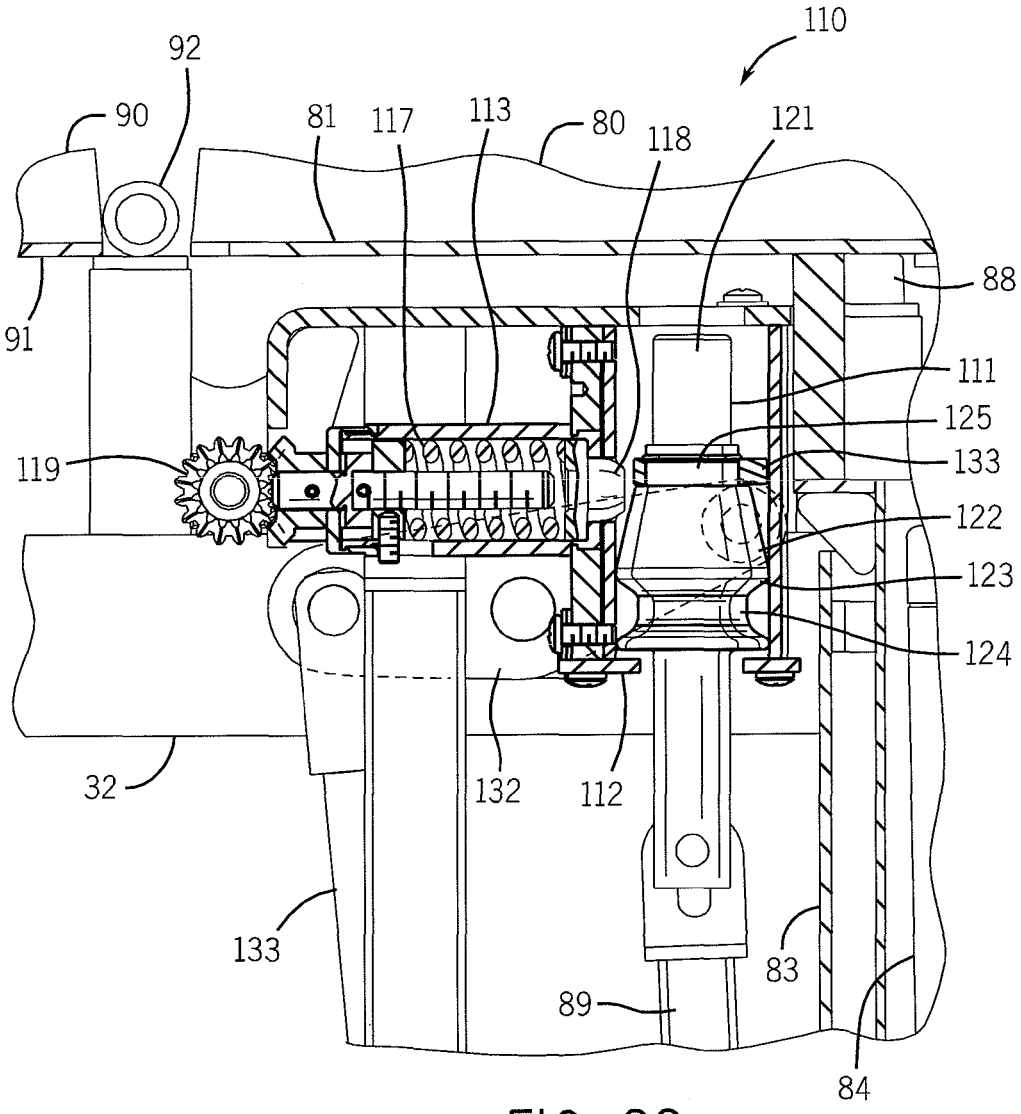
FIG. 22 is a greatly enlarged cross-sectioned and left side elevational view of the drop pin assembly in the pelvic portion of the table.
Figure 23:
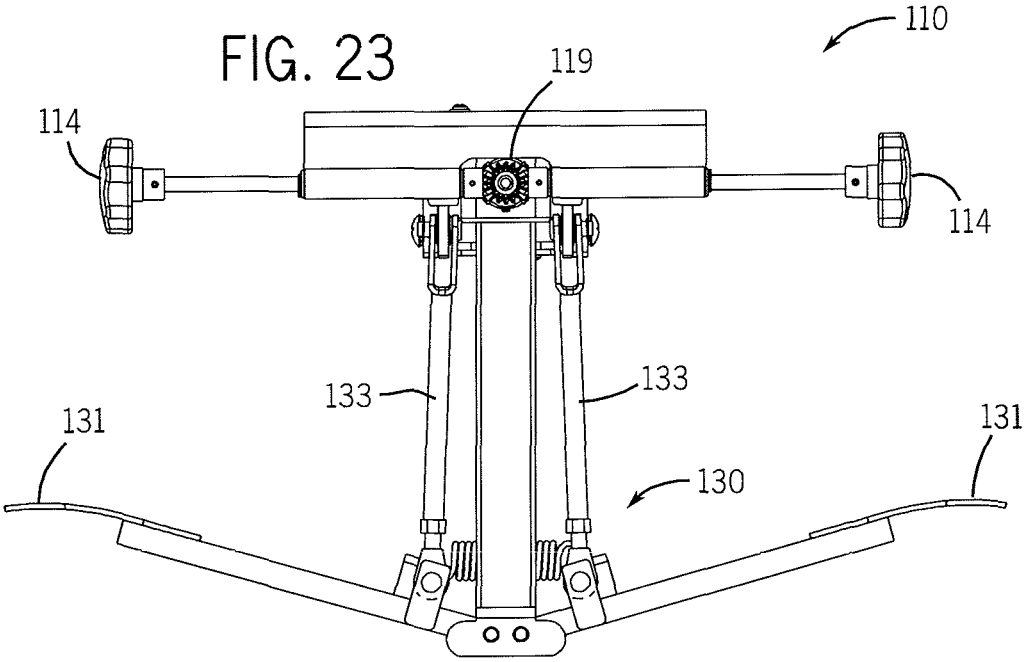
FIG. 23 is a rear elevational view of the foot pedal-cocking assembly illustrated in FIG. 18 and showing the foot pedals in the "up" position.
Figure 24:
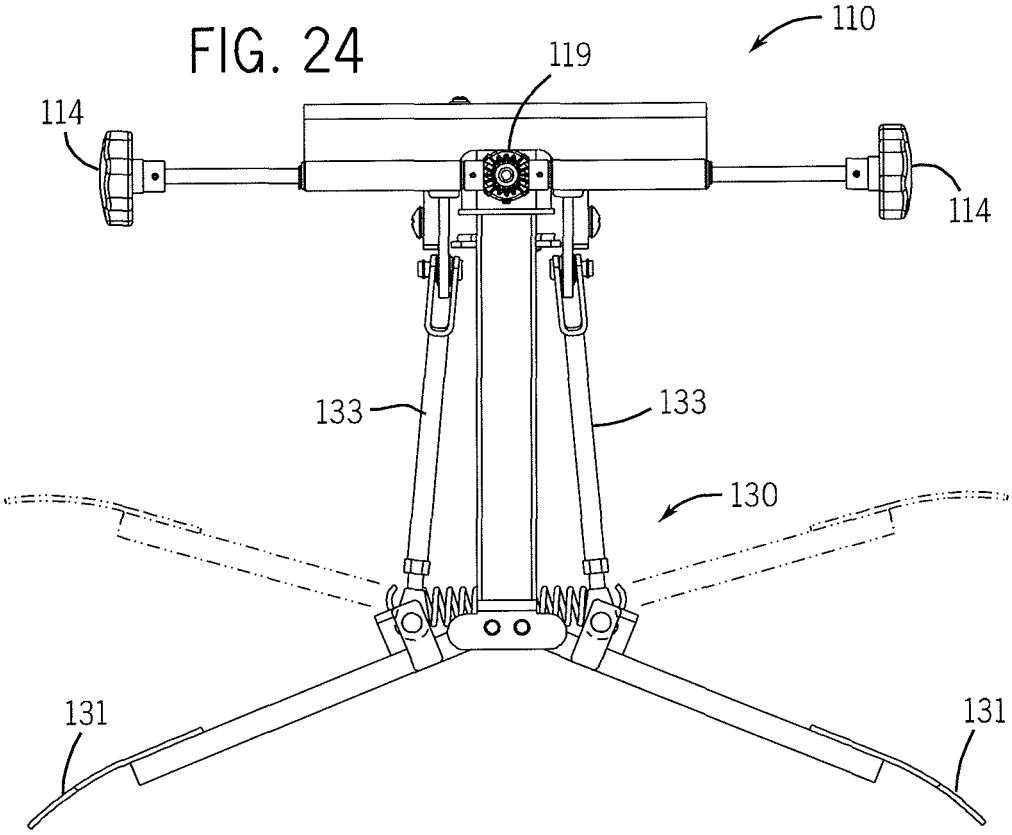
FIG. 24 is a view similar to that illustrated in FIG. 23 and showing the foot pedals in the "down" position.

Referring now to FIGS. 20 through 22 in particular, it will be seen that a pelvic drop sub-assembly 110 is also provided. The pelvic drop sub-assembly 110 comprises a drop pin 111, a bottom stop 112, a tension tube 113, a pair of bilateral tension knobs 114 and a miter gear assembly 119. As shown, the tension tube 113 houses a tensioning spring 117 that biases a release member 118 against the drop pin 111. The drop pin 111 comprises a cylindrically-shaped upper portion 121 and a circumferential and outwardly tapered bottom portion 122, the bottom portion 122 terminating in a circumferential ridge 123 and capture groove 124. In the preferred embodiment, the cocking bar or lever (as was used with the other pad elements previously discussed) is replaced by a foot lever sub-assembly 130. See FIGS. 18, 23 and 24. The foot lever sub-assembly 130 is attached to a link 133 which allows the drop pin 111 to be "cocked" by the practitioner pushing down on one of two spring-loaded bilateral foot pedals 131. Depression of the foot pedal 131 rotates a linkage 132 that elevates a plate 133 that engages a collar portion 125 of the drop pin 111. In this motion, the upper portion 121 of the drop pin 111 urges the pelvic pad plate 81 upwardly to the pre-drop position shown in FIG. 21. In this position, the release member 118 housed within the tension tube 113 is captured within the groove 124 of the drop pin 111. The drop pin 111 is further attached to a bottom-most shaft 129 by means of a pelvic drop link 89. The bottom-most shaft 129 is also attached to the lowest portion of the hydraulic tube 86 of the pelvic drop portion of the table 10. This results in coordinated movement between the drop pin 111 and the pelvic pad 80.

Figure 25:
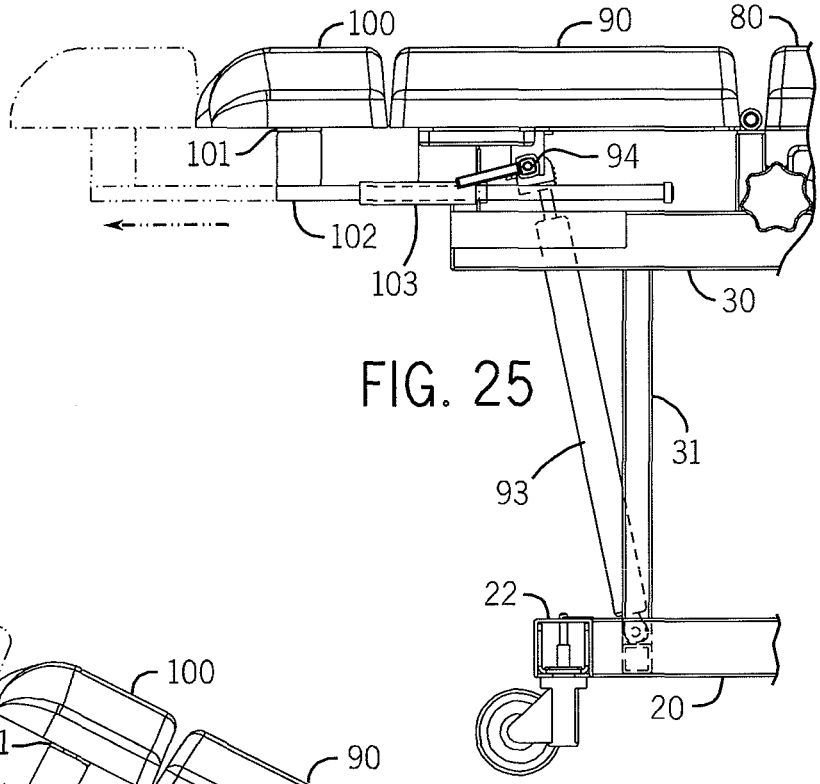
FIG. 25 is a partial left side elevational view of the leg and foot portions of the table illustrated in FIG. 4 and showing the leg and foot portions in their fully "down" position.
Figure 26:
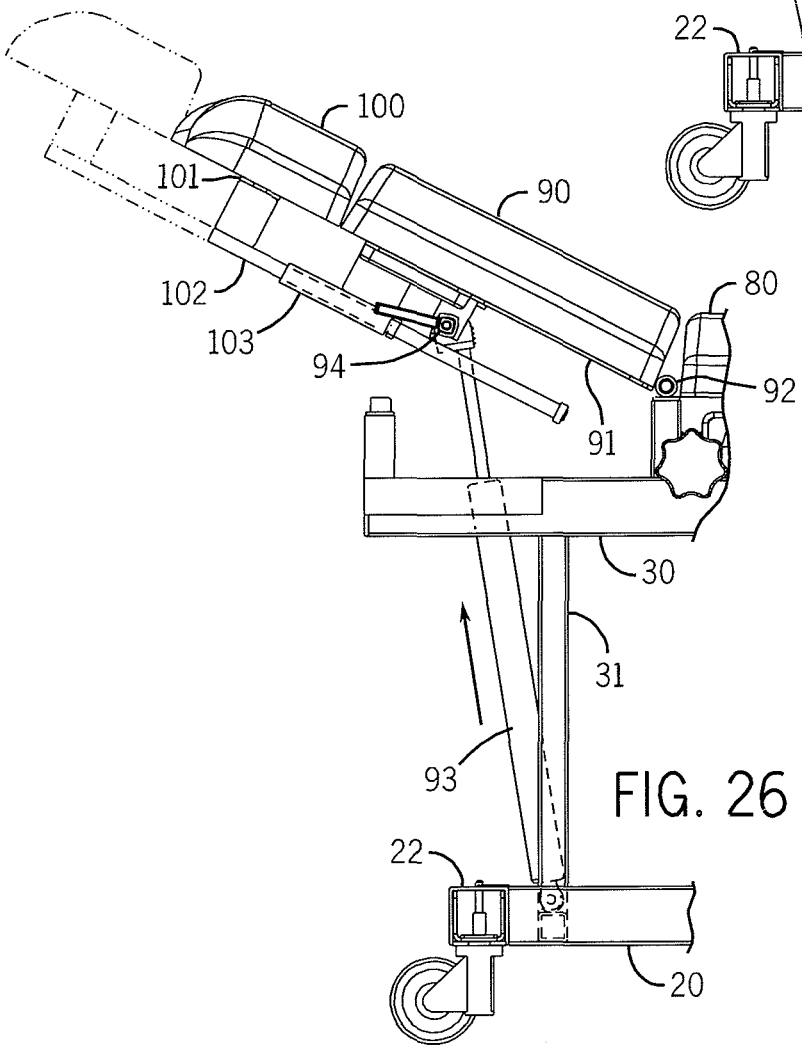
FIG. 26 is a view similar to that illustrated in FIG. 25 and showing the leg and foot portions in an "up" or raised position.

Finally, disposed at the rearward-most end of the table 10 of the present invention are the leg pad 90 and the foot pad 100. See FIGS. 3, 4, 25 and 26 in particular. As shown, the leg pad 90 is supported by and attached to a leg pad plate 91. The leg pad plate 91 is attached to the top frame 30 by means of a hinge 92. The hinge 92 allows the leg pad plate 91 and leg pad 90 to rotate about the top frame 30. The leg pad plate 91 is variably positionable relative to the horizontal by means of a hydraulic tube 93 and actuation lever 94 of the type previously described. The foot pad 100 is attached to a supported by a foot pad bracket 101. The foot pad bracket 101 is secured to a longitudinally-extending slide 102, the slide being longitudinally moveable along a slide receiver 103. This movement is shown in phantom view in FIGS. 25 and 26.

In view of the foregoing, it will be apparent that there has been provided an improved posture correction tool in the form of a chiropractic adjusting table that has certain new, useful and non-obvious features including "flying drops" in the thoracic and lumber sections; pelvic elevation "flying drop" in the pelvic section; a cervical instrument adjusting fulcrum; a uniquely-movable head piece; polyurethane pads; and which is easy to move and eliminates conventional "pinch points" for enhanced safety.

The details of the invention having been disclosed in accordance with the foregoing, I claim:

1. A chiropractic adjustment table comprising:
- a superstructure attached to a base;
- a plurality of body-supporting pads mounted to the superstructure, the plurality of pads being disposed longitudinally and each pad having an upper surface that defines a first horizontal plane when the pads are disposed in a substantially flat neutral position;
- a head pad attached to the superstructure, the head pad being adjustable vertically to positions above and below the first horizontal plane and the head pad further being adjustable angularly to tilt upwardly or downwardly relative to the first horizontal plane;
- wherein the head pad can be dropped from any vertical position, from any angled position, or both; and
- a cervical pad, the cervical pad being an adjusting fulcrum comprising an elongated and transversely-disposed pad mounted atop a vertical support structure, the cervical pad being positioned between the plurality of body-supporting pads and the head pad, the cervical pad being adjustable vertically to positions above and below the first horizontal plane and the transversely-disposed pad of the cervical pad further being rotatably adjustable in a second horizontal plane about the vertical support structure when the pad is positioned above the first horizontal plane, wherein the second horizontal plane is parallel with the first horizontal plane.

2. The chiropractic adjustment table of claim 1 wherein the head pad is raised and lowered electrically.

3. The chiropractic adjustment table of claim 1 wherein the angle of the head pad is adjustable hydraulically.

4. The chiropractic adjustment table of claim 1 further comprising a head pad drop assembly comprising:
- a cylindrically shaped drop pin having a capture groove;
- a spring biased tension tube; and
- a handle, the handle being operable to elevate the drop pin and the head pad until the tension tube locks into the capture groove of the drop pin.

5. The chiropractic adjustment table of claim 4 wherein the head pad is operable to drop when downward pressure on the head pad overcomes the spring biased tension tube.

6. The chiropractic adjustment table of claim 5 wherein the spring tension in the spring biased tension tube is adjustable.

7. The chiropractic adjustment table of claim 1 wherein the plurality of body-supporting pads comprises:
- a leg pad attached to the superstructure;
- a pelvic pad attached to the superstructure;
- a lumbar pad and a thoracic pad hingedly connected to the superstructure; and
- a hydraulic tube for use with the lumbar pad and the thoracic pad, the tube having a first end connected to the superstructure of the base and a second end, the second end of the hydraulic tube being attached to the underside of the lumbar pad and the thoracic pad and being operable to raise and lower the lumbar pad and the thoracic pad.

8. The chiropractic adjustment table of claim 7 wherein the thoracic pad is hingedly connected to the lumbar pad.

9. The chiropractic adjustment table of claim 7 further comprising a thoracic pad drop assembly comprising:
- a cylindrically shaped drop pin having a capture groove;
- a spring biased tension tube for use with the thoracic pad drop assembly;
- and
- a handle, the handle being operable to elevate the drop pin and the thoracic pad until the tension tube locks into the capture groove of the drop pin.

10. The chiropractic adjustment table of claim 9 wherein the thoracic pad is operable to drop when downward pressure on the thoracic pad overcomes the spring biased tension tube.

11. The chiropractic adjustment table of claim 10 wherein the spring tension in the spring biased tension tube is adjustable.

12. The chiropractic adjustment table of claim 1 further comprising a lumbar pad drop assembly comprising:
- a cylindrically shaped drop pin having a capture groove;
- a spring biased tension tube; and
- a handle, the handle being operable to elevate the drop pin until the tension tube locks into the capture groove of the drop pin.

13. The chiropractic adjustment table of claim 12 wherein the lumbar pad is operable to drop when downward pressure on the thoracic pad overcomes the spring biased tension tube.

14. The chiropractic adjustment table of claim 13 wherein the spring tension in the spring biased tension tube is adjustable.

15. The chiropractic adjustment table of claim 1 wherein the plurality of body-supporting pads comprises:
- a. leg pad attached to the superstructure;
- a pelvic pad, the pelvic pad being attached to the superstructure via a hydraulic tube, the hydraulic tube being operable to both raise and lower the pelvic pad;
- a lumbar pad connected to the superstructure; and
- a thoracic pad connected to the superstructure.

16. The chiropractic adjustment table of claim 15 further comprising a pelvic pad drop assembly comprising:

a cylindrically shaped drop pin having a capture groove;

a spring biased tension tube; and a foot pedal, the foot pedal being operable to elevate the drop pin and the pelvic pad until the tension tube locks into the capture groove of the drop pin.

17. The chiropractic adjustment table of claim 16 wherein the pelvic pad is operable to drop when downward pressure on the pelvic pad overcomes the spring biased tension tube.

18. The chiropractic adjustment table of claim 17 wherein the spring tension in the spring biased tension tube is adjustable.

19. The chiropractic adjustment table of claim 1 wherein the head pad can be vertically adjusted within a range from about 8 inches above and about 3 inches below the horizontal plane.

20. The chiropractic adjustment table of claim 19 wherein the head pad can be angularly adjusted within a range from about 45° above the horizontal to about 45° below the horizontal from any vertical position within the vertical adjustment range.

21. The chiropractic adjustment table of claim 1 wherein the cervical pad is normally positioned transversely perpendicular relative to the table and provides an adjusting fulcrum to support a patient's neck wherein the cervical pad can be rotationally adjusted within a range from about 15° in flexion and about 15° in extension relative to its normal transverse position.

22. A chiropractic adjustment table comprising:

a longitudinally extending superstructure attached to a base;

a plurality of body-supporting pads attached to the superstructure, each of the body-supporting pads being a flying drop section, and the plurality of body-supporting pads comprising a head pad having a top surface and a thoracic pad having a top surface, the top surfaces being adjustable to form a first horizontal plane;

a pelvic pad that is vertically adjustable; and a cervical pad comprising an adjusting fulcrum that is disposed between the thoracic pad and the head pad, the cervical pad comprising a T-shaped structure that is formed from a vertical support structure and a top structure pad that is normally disposed transversely to the superstructure, the cervical pad further being vertically adjustable to positions above and below the first horizontal plane and the top support pad of the cervical pad being rotatable about the vertical support structure and within a second horizontal plane when the top support pad of the cervical pad is positioned above the first horizontal plane;

wherein the second horizontal plane is parallel with the first horizontal plane;

wherein each of the plurality of body-supporting pads and the pelvic pad comprises a pad that can be elevated and then cocked and dropped from that elevated position; and wherein each of the plurality of body-supporting pads comprises a pad that can also be angled and then cocked and dropped from that angled position.

* * * * *